US005541722A

United States Patent [19]

Ikeda et al.

[11] Patent Number: 5,541,722

[45] Date of Patent: Jul. 30, 1996

[54] COLOR IMAGE FORMING APPARATUS

[75] Inventors: Tadayoshi Ikeda; Masakazu Fukuchi; Satoshi Haneda, all of Hachioji, Japan

[73] Assignee: Konica Corporation, Tokyo, Japan

[21] Appl. No.: 402,636

[22] Filed: Mar. 13, 1995

[30] Foreign Application Priority Data

| | | | |
|---|---|---|---|
| Mar. 16, 1994 | [JP] | Japan | 6-045935 |
| May 12, 1994 | [JP] | Japan | 6-098849 |
| Jun. 24, 1994 | [JP] | Japan | 6-143358 |

[51] Int. Cl.[6] ..... G03G 15/01

[52] U.S. Cl. ..... 355/326 R; 118/645

[58] Field of Search ..... 355/210, 211, 355/245, 327, 326 R; 118/645, 653, 656

[56] References Cited

U.S. PATENT DOCUMENTS

| | | | |
|---|---|---|---|
| 3,836,363 | 9/1974 | Plutchak | 355/326 R X |
| 4,803,514 | 2/1989 | Hiratsuka et al. | 355/211 |
| 4,961,094 | 10/1990 | Yamaoki et al. | 355/326 R |
| 5,065,183 | 11/1991 | Morofuji et al. | 355/326 R X |

FOREIGN PATENT DOCUMENTS 5-307307 11/1993 Japan .

*Primary Examiner*—William J. Royer

*Attorney, Agent, or Firm*—Frishauf, Holtz, Goodman, Langer & Chick

[57] ABSTRACT

A color image forming apparatus in which a charging, imagewise exposing and developing operations are repeated onto an image forming drum to register different colored toner images thereon and thereby to transfer simultaneously the toner images onto a recording sheet, includes four imagewise exposing units which are disposed inside the image forming drum and are fixed in a main body of the image forming apparatus. Two each of the exposing units and the developing units are disposed respectively on both sides with predetermined angles with respect to a vertical line passing through the center of the image forming drum. The apparatus further includes a transferring device and a cleaning device are disposed respectively with predetermined angles on different one side of the vertical line below a horizontal line intersecting with the center of the image forming drum.

12 Claims, 19 Drawing Sheets

COLOR IMAGE FORMING APPARATUS

BACKGROUND OF THE INVENTION

The present invention relates to an electrophotographic color image forming apparatus wherein a plurality of imagewise exposure means and developing means are arranged along the circumferential surface of an image-forming object that is mainly in a drum shape, and toner images are formed and superimposed while the image-forming object is rotated within one turn.

As a method for forming a multi-color image, there have been known some methods including apparatus (A) wherein photoreceptors, charging units and developing units each in quantity equivalent to the number of colors necessary for the multi-color image are provided, and toner images each being a mono-color formed on each photoreceptor are superimposed on an intermediate transfer object to form a color image, apparatus (B) wherein one photoreceptor is caused to make plural turns so that charging, imagewise exposure and developing for each color are repeated for forming a color image, and apparatus (C) wherein charging, imagewise exposure and developing for each color are conducted in succession while one photoreceptor makes one turn for forming a color image.

However, the apparatus (A) has a drawback that the apparatus is destined to be large in size because a plurality of photoreceptors and intermediate transfer objects are required, while the apparatus (B) has a restriction that a size of an image formed is limited to the surface area or less of the photoreceptor though the apparatus can be small in size because the required number of each of the charging means, imagewise exposure means and photoreceptor is just one.

In the case of the apparatus (C), although it makes it possible to form images at high speed, it still has a contradiction that a diameter of a photoreceptor is large and thereby the apparatus is also large due to the following two reasons; one is necessity that a plurality of charging units, imagewise exposure means and developing units need to be arranged within a circumferential surface of the photoreceptor, and the other is necessity that the distance between the imagewise exposure means and the developing unit needs to be large for avoiding a fear that image quality is deteriorated by toner leaking from the developing unit to which an imagewise exposure optics system is close.

For the purpose of avoiding a drawback of the aforementioned contradiction in the apparatus (C), there has been suggested an apparatus wherein the base of an image-forming object is formed with a transparent material, a plurality of imagewise exposure means are housed inside the image-forming object, and a light-sensitive layer formed on the external surface of the base is exposed to light reflected on an image through the base (for example, Japanese Patent Publication Open to Public Inspection No. 307307/1993 (hereinafter referred to as Japanese Patent O.P.I Publication)).

However, the apparatus in accordance with the aforementioned suggestion has disadvantages including complicated structure due to arrangement of many imagewise exposure means inside the image-forming object and many charging units and developing units outside the image-forming object, inefficient handling due to complicated mounting and dismounting of developing units, image-forming objects and imagewise exposure means, and difficulty of keeping positional accuracy between various units. In particular, it is difficult to provide an optics system fixed inside the image-forming object and to rotate it or to mount and dismount it. It is further preferable that a common structure is used for various developing units.

It is further difficult on the apparatus in accordance with the aforementioned suggestion that optics systems such as LED, LCS, PLZT, LISA and others are arranged inside the image-forming object and the image-forming object is rotated, or mounted and dismounted.

With regard to the exposure optics system, in particular, positional relationship between various parts in the optics system and that between the optics system and the image-forming object are kept to be highly accurate. Therefore, when deformation or displacement is caused by the mounting or dismounting of the image-forming object, registration or an image forming position is changed, resulting in inability to obtain excellent color images. It is preferable to integrate developing units and others to the utmost.

Further, under a certain layout of those units, a toner hopper can be built in without providing any large space in particular, and it is easy to connect it to or integrate it into developing units.

Furthermore, in the aforementioned apparatus (C), it is possible to use an image-forming object having a small diameter due to an imagewise exposure means housed therein, and it is possible to make volume of the apparatus small. However, when incorporating a duplex copy function, the apparatus is required to be high and its compactness is lost because it is necessary to incorporate a known sheet reversing and feeding path which reverses a transfer material and feeds it to the transfer section again.

There is further a problem that the length of sheet feeding path is increased and thereby frequency of jam occurrence is enhanced.

SUMMARY OF THE INVENTION

A first object of the invention is to provide a compact color image forming apparatus wherein a balance and positional accuracy of units in the apparatus are kept to be highly accurate due to the rationalized layout, and easy operation can be offered.

A second object of the invention is to provide a compact color image forming apparatus -wherein an image-forming object can be mounted or dismounted without adversely affecting an imagewise exposure means installed accurately, a balance and positional accuracy of units in the apparatus are kept to be highly accurate due to the rationalized layout, a toner supply function is built in, and easy operation can be offered.

A third object of the invention is to provide a color image forming apparatus wherein the height of the apparatus can be limited due to realization of an extremely simple sheet reversing and feeding path, and maintenance such as jam clearance and others can be carried out easily.

The first embodiment of the invention for attaining the first object mentioned above is represented by a color image forming apparatus comprising an image-forming object for which charging, imagewise exposure and developing are repeated to superimpose toner images on the image-forming object for forming images transferred simultaneously onto a transfer material, wherein the aforementioned image-forming object is a drum-shaped one and contains a plurality of imagewise exposure means affixed to the apparatus main body, two each of the imagewise exposure means and the developing means are arranged respectively at right side and left side of a vertical line passing through the center of the drum-shaped image-forming object, and a transfer means is positioned at one side of the vertical line under a horizontal line passing through the center of the drum-shaped image-forming object, while a cleaning means is positioned at the other side thereof.

The second embodiment of the invention is represented by a color image forming apparatus comprising an image-forming object for which charging, imagewise exposure and developing are repeated to superimpose toner images on the image-forming object for forming images transferred simultaneously onto a transfer material, wherein the aforementioned image-forming object contains a plurality of imagewise exposure means affixed to the apparatus main body, and the imagewise exposure position is at the upstream side of a developing area of the developing means and imagewise exposure is carried out at the position inside a container of the developing means.

The third embodiment of the invention is represented by a color image forming apparatus comprising a drum-shaped image-forming object for which charging, imagewise exposure and developing are repeated to superimpose toner images on the image-forming object for forming images transferred simultaneously onto a transfer material, wherein the aforementioned image-forming object contains a plurality of imagewise exposure means affixed to the apparatus main body, two each of the imagewise exposure means and the developing means are arranged respectively at right side and left side of a vertical line passing through the center of the drum-shaped image-forming object, and a transfer means is positioned at one side of the vertical line over a horizontal line passing through the center of the drum-shaped image-forming object, while a cleaning means is positioned at the other side thereof.

The first embodiment of the invention for attaining the second object mentioned above is represented by a color image forming apparatus comprising a drum-shaped image-forming object for which charging, imagewise exposure and developing are repeated to superimpose toner images on the image-forming object for forming images transferred simultaneously onto a transfer material, wherein the aforementioned image-forming object contains a plurality of imagewise exposure means affixed to the apparatus main body, a plurality of the developing means are arranged at the upper and lower sides and right and left sides of a vertical line passing through the center of the image-forming object, and each of the plural developing means is equipped with toner hoppers positioned at symmetrical right and left positions side by side at the upper portion of the developing means.

The second embodiment of the invention is represented by a color image forming apparatus comprising an image-forming object for which charging, imagewise exposure and developing are repeated to superimpose toner images on the image-forming object for forming images transferred simultaneously onto a transfer material, wherein each of the plural developing means is equipped with a toner supply inlet capable of being opened and closed, and the toner supply inlet is opened when a toner hopper is mounted for toner supply.

The third embodiment of the invention is represented by a color image forming apparatus comprising an image-forming object for which charging, imagewise exposure and developing are repeated to superimpose toner images on the image-forming object for forming images transferred simultaneously onto a transfer material, wherein each of the plural developing means and a hopper are united integrally, and when the developing means has passed its service life, a toner supply outlet of the toner hopper is prevented from being opened.

In the explanation of the aforementioned second and third embodiments, there is used a color image forming apparatus wherein an imagewise exposure system is provided inside the first embodiment. However, the invention is not limited to this but it can also be applied to a color image forming apparatus wherein an imagewise exposure system is provided outside.

The first embodiment of the invention for attaining the third object mentioned above is represented by a color image forming apparatus comprising an image-forming object for which charging, imagewise exposure and developing are repeated to superimpose toner images on the image-forming object for forming images transferred simultaneously onto a transfer material, wherein the fixing means mentioned above has a function of pressure contact and releasing of the pressure contact, and it is released from its pressure contact after a transfer material on one side of which toner images are transferred has passed, while when the above-mentioned transfer material conveyed reversely has passed, the fixing means is caused to be in pressure contact for fixing the transfer material which has passed through the sheet reversing and feeding path so that toner images are transferred onto the reverse side of the transfer material.

The second embodiment is represented by a color image forming apparatus comprising an image-forming object for which charging, imagewise exposure and developing are repeated to superimpose toner images on the image-forming object for forming images transferred simultaneously onto a transfer material, wherein the fixing means mentioned above has a function of pressure contact and releasing of the pressure contact, and it is released from its pressure contact after a transfer material on one side of which toner images are transferred has passed, while when the above-mentioned transfer material conveyed reversely has passed, the fixing means is caused to be in pressure contact, and after the transfer material passing through the sheet reversing and feeding path and having transferred toner images on its reverse side has passed, it is released from pressure contact again so that the transfer material is conveyed reversely, thus the transfer sheet is caused to pass through the sheet reversing and feeding path again to be ejected.

The third embodiment is represented by a color image forming apparatus comprising an image-forming object for which charging, imagewise exposure and developing are repeated to superimpose toner images on the image-forming object for forming images transferred simultaneously onto a transfer material, wherein the above-mentioned apparatus is composed of an upper half main body and a lower half main body to be of a clamshell type, and it is equipped with a duplex unit that feeds the transfer sheet having on its one side transferred toner images to the image transfer section again after the sheet has passed through the fixing means so that toner images may be transferred onto the reverse side, and a sheet feeding face of the duplex unit can be opened when the upper half main body is opened.

The fourth embodiment is represented by a color image forming apparatus comprising an image-forming object for which charging, imagewise exposure and developing are repeated to superimpose toner images on the image-forming object for forming images transferred simultaneously onto a transfer material, wherein the above-mentioned apparatus is equipped with a duplex unit that feeds the transfer sheet having on its one side transferred toner images to the image transfer section again after the sheet has passed through the fixing means so that toner images may be transferred onto the reverse side of the transfer material, and the duplex unit can be drawn out of the side where transfer sheets are fed, and a sheet-feeding surface can be opened at the position for drawing out the duplex unit.

The fifth embodiment is represented by a color image forming apparatus comprising an image-forming object for which charging, imagewise exposure and developing are repeated to superimpose toner images on the image-forming object for forming images transferred simultaneously onto a transfer material, wherein the conveyance direction of a belt-shaped conveying member that conveys the transfer material from the image transfer section to the fixing means is changed by a pair of roller members which are inscribed and circumscribed respectively.

DETAILED DESCRIPTION OF THE PREFERRED EMBODIMENT

Figure 1:
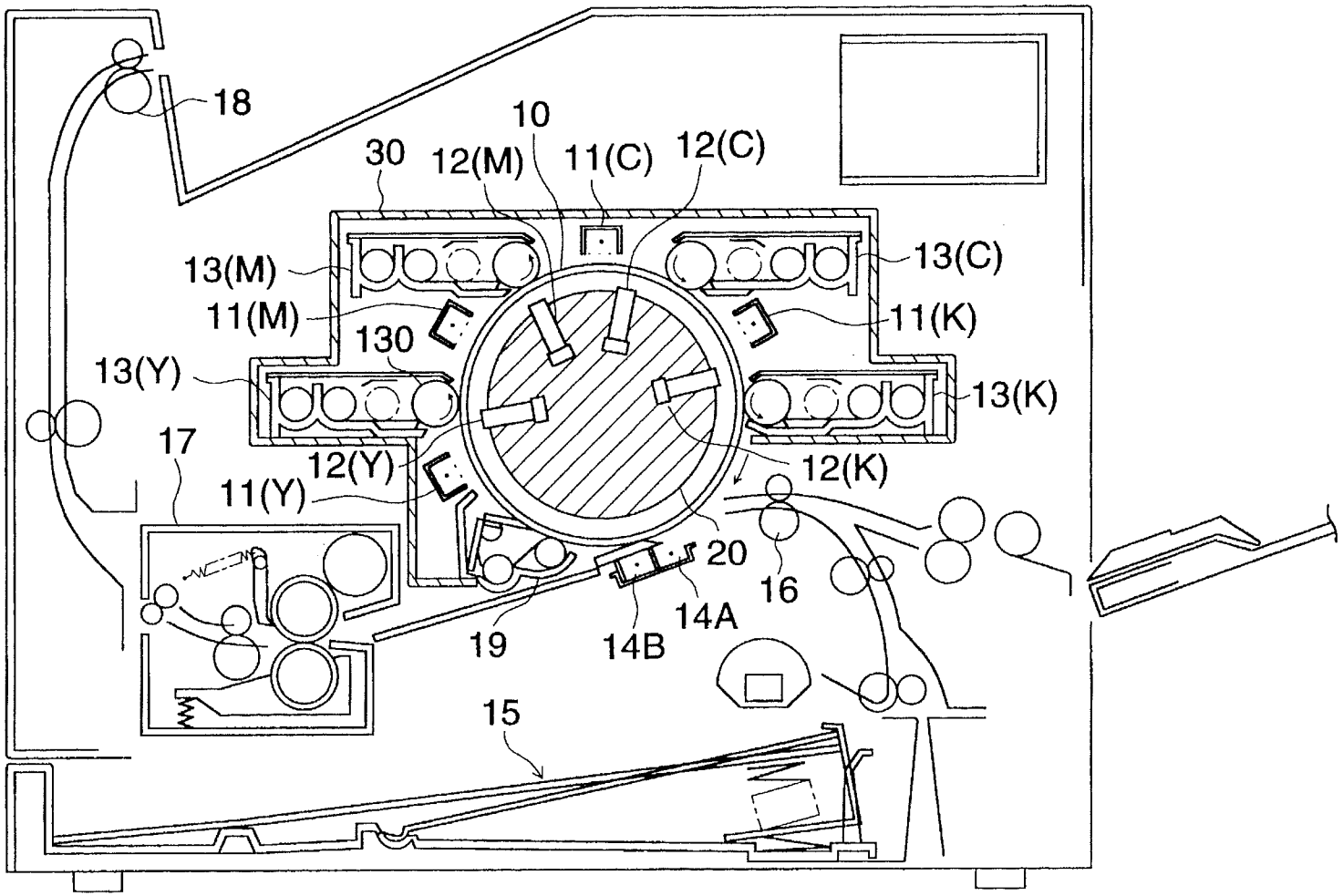
FIG. 1 is a sectional view showing the structure of a color image forming apparatus in accordance with the first and second embodiments for attaining the first object of the invention.
Figure 2:
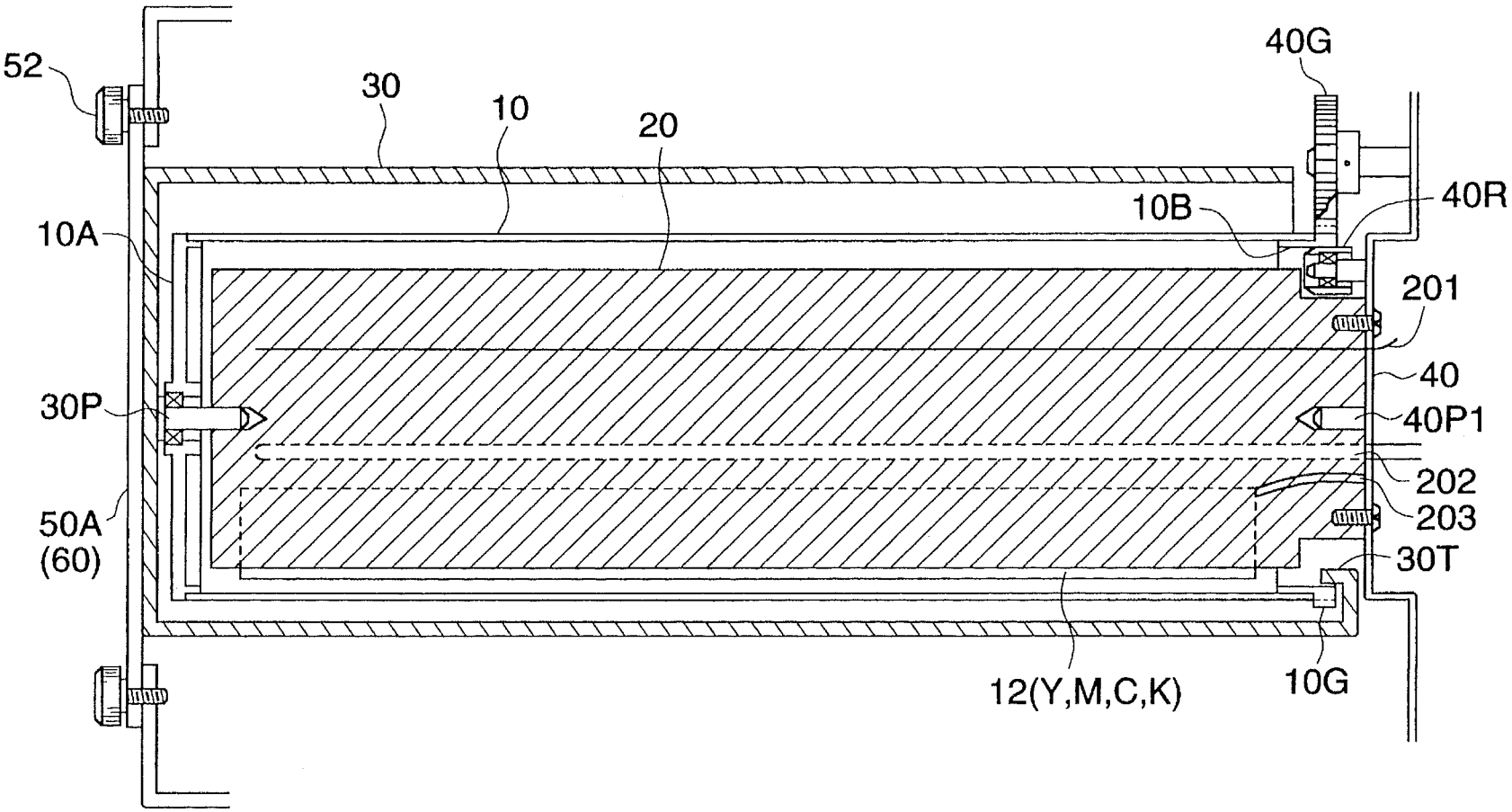
FIG. 2 is a section view of a primary portion of the apparatus mentioned above.

Prior to explanation of the examples 1–3 attaining the first object of the invention, constitution of a color image forming apparatus which is common to all examples will be explained as follows, referring to FIGS. 1 and 2.

The numeral 10 is a drum-shaped image-forming object, that is, a photoreceptor drum, and it is composed of a cylindrical base object made of optical glass or a transparent member such as transparent acrylic resins whose external circumferential surface is coated with a transparent conductive layer or an organic photoconductor layer (OPC).

With regard to the photoreceptor drum 10, its flange 10A located at one end thereof is bearing-supported by guide pin 30P provided on cartridge 30 described later and flange 10B located at the other end engages with a plurality of guide rollers 40R provided on base plate 40 of the apparatus main body so that external gear 10G may engage with driving gear 40G, thus, the photoreceptor drum is rotated by motive power clockwise with the transparent conductive layer grounded.

The numerals 11(Y), 11(M), 11(C) and 11(K) represent a scorotron charging unit, and they charge electrically the aforementioned organic photoconductor layer of the photoreceptor drum 10 by means of a grid retained at a predetermined potential level and of corona discharge by a corona wire, thus the photoreceptor drum 10 is given uniform potential.

The numerals 12(Y), 12(M), 12(C) and 12(K) represent an exposure optics system composed of LEDs and SELFOC lenses serving as a life-size image forming element both arranged in the axial direction of the photoreceptor drum 10, and image signals for each color read by a separate image reading device are taken out successively from a memory and are inputted as electric signals into each of the aforesaid exposure optics systems 12(Y), 12(M), 12(C) and 12(K).

Each of the aforesaid exposure optics systems 12(Y), 12(M), 12(C) and 12(K) is attached on cylindrical supporting member 20 that is affixed on base plate 40 of the apparatus main body being guided by guide pin 40P1, thus the aforesaid exposure optics systems are housed inside the base of the photoreceptor drum 10.

The numerals 13(Y), 13(M), 13(C) and 13(K) are developing units containing respectively developing agents of yellow (Y), magenta (M), cyan (C) and K (black), and they are equipped respectively with developing sleeves 130 which rotate in the same direction keeping a certain distance from each other around the circumferential surface of the photoreceptor drum 10.

An electrostatic latent image formed on the photoreceptor drum 10 through charging made by each of the charging units 11(Y), 11(M), 11(C) and 11(K) and through imagewise exposure made by each of the aforementioned exposure optics systems 12(Y), 12(M), 12(C) and 12(K) is subjected to reversal development conducted on a non-contact basis by each of the developing units through impression of developing bias.

Next, a process of a color image forming apparatus in the present apparatus will be explained as follows.

With regard to an image on a document, the image read by an image sensor in an image reading device which is separate from the present apparatus, or the image compiled by a computer is stored in a memory momentarily as image signals of each color of Y, M, C and K.

At the start of image recording, the driving gear 40G is rotated when the photoreceptor driving motor starts rotating, and photoreceptor drum 10 is thereby rotated clockwise and charging unit 11(Y) starts giving potential to the photoreceptor drum 10 through its charging action simultaneously, After the photoreceptor drum 10 is given potential, exposure by means of electric signals corresponding to the first color signals, namely yellow (Y) image signals are started in the exposure optics system 12(Y), and an electrostatic latent image corresponding to a yellow (Y) image of the document image is formed on a light-sensitive layer on the surface of the drum through rotary scanning of the drum.

The latent image mentioned above is subjected to reversal development conducted by developing unit 13(Y) under the condition that the developing agent on a developing sleeve is in the non-contact state, and a yellow (Y) toner image is formed as the photoreceptor drum 10 rotates.

Then, photoreceptor drum 10 is given potential on the yellow (Y) toner image thereon through charging operation of charging unit 11(M), then it is exposed to electric signals of exposure optics system 12(M) corresponding to the second color signals, namely to magenta (M) image signals, and thereby a magenta (M) toner image is superposed on the aforementioned yellow (Y) toner image through reversal development of a non-contact type conducted by developing unit 13(M).

In the same process as in the foregoing, a cyan (C) toner image corresponding to the third color signals formed by charging unit 11(C), exposure optics system 12(C) and developing unit 13(C) and a black (K) toner image corresponding to the fourth color signals formed by charging unit 11(K), exposure optics system 12(K) and developing unit 13(K) are formed and superposed in succession, thus a color toner image is formed on the circumferential surface of the photoreceptor drum 10 within its one rotation.

Exposure to an organic photoconductor layer of photoreceptor drum 10 is conducted by exposure optics systems mentioned above through the transparent base object from the inside of the drum. Therefore, exposures of images corresponding respectively to the second, third and fourth color signals can be conducted without being affected by toner images formed in the preceding steps, thus it is possible to form an electrostatic latent image identical to that corresponding to the first color signals. Incidentally, with regard to stabilization of a temperature and prevention of temperature rise in photoreceptor drum 10 relating to generation of heat caused by exposure optics systems 12(Y), 12(M), 12(C) and 12(K), a material having an excellent thermal conductivity is used for the supporting member 20, and when the temperature is low, heater 201 is used, while it is high, heat pipe 202 is used for radiation of heat, thus it is possible to control the temperature up to the level at which no problem is caused. In the case of developing operation conducted by each developing unit, developing bias to which D.C. is added or A.C. is further added is impressed on each developing sleeve 10, then jumping development by means of mono-component or two-component developing agent contained in a developing unit is conducted, and reversal development of a non-contact basis is carried out for the photoreceptor drum 10 having a grounded transparent conductive layer.

Thus, the color toner image formed on the circumferential surface of the photoreceptor drum 10 is transferred by transfer unit 14A onto a transfer sheet that is conveyed from sheet feed cassette 15 and is fed while being synchronized by timing roller 16.

The transfer sheet on which the toner image has been transferred is neutralized by neutralizing unit 14B and is separated from the circumferential surface of the drum, then is subjected to toner fusion at fixing unit 17, and is ejected on the tray located at the upper portion of the apparatus through exit roller 18.

On the other hand, the photoreceptor drum 10 from which the transfer sheet has been separated is cleared of residual toner remaining thereon at cleaning unit 19, and is cleaned for continuation of forming toner images from the images on the same document, or it stops momentarily for formation of toner images from another image on the document.

The aforementioned photoreceptor drum 10, charging units 11(Y), 11(M), 11(C) and 11(K), developing units 13(Y), 13(M), 13(C) and 13(K) and cleaning unit 19 are all housed in cartridge 30, and all of them except supporting member 20 having therein exposure optics systems 12(Y), 12(M), 12(C) and 12(K) can be mounted inside the apparatus main body or dismounted therefrom solidly.

Figure 3:
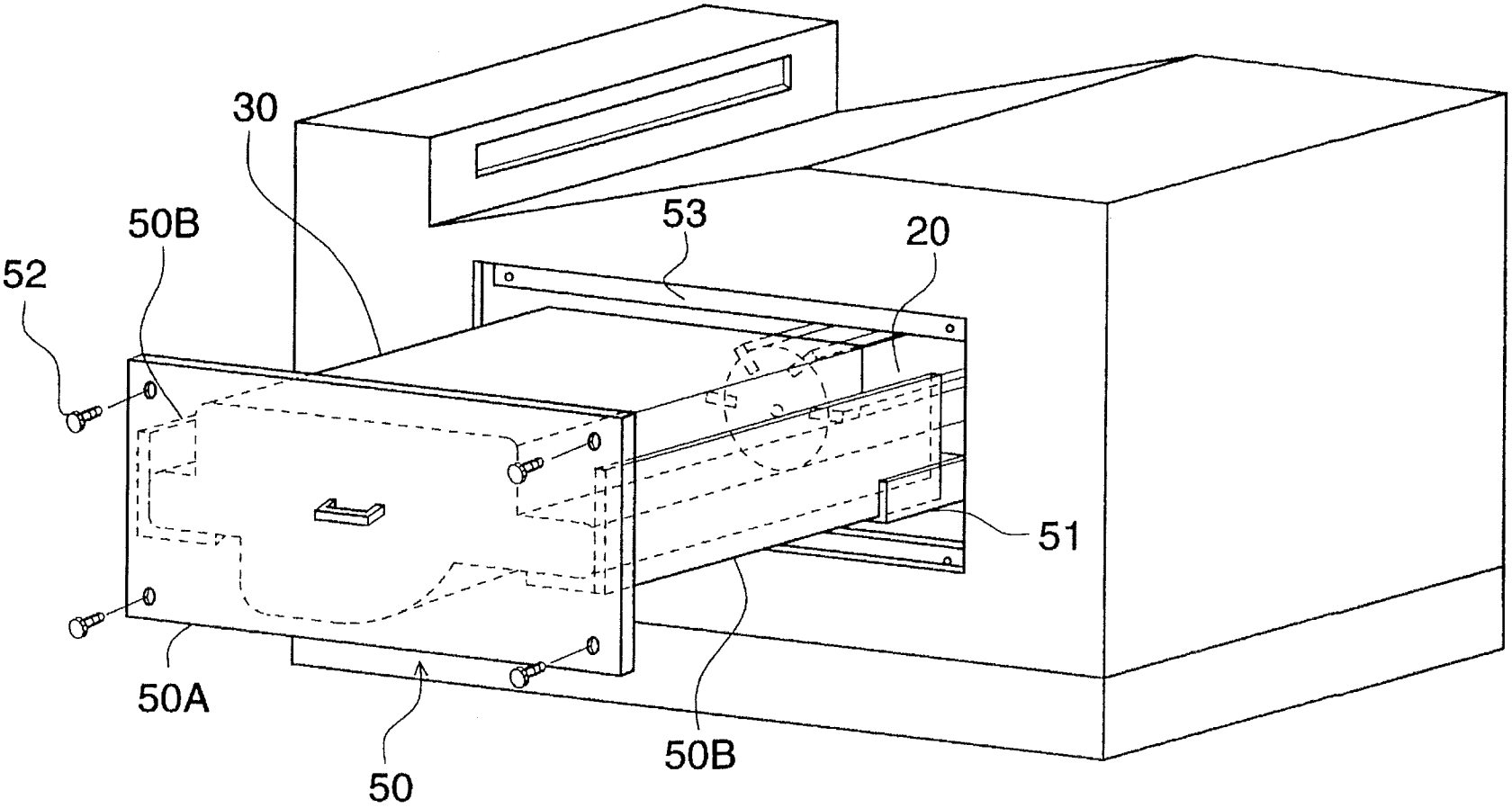
FIG. 3 is a perspective view showing how a cartridge is loaded or unloaded.

Namely, the cartridge 30 is housed in holder 50 that is shown in FIG. 3 and is provided on the side of the apparatus main body to be capable of being mounted or dismounted so that the cartridge 30 can be inserted into or drawn out from the apparatus main body.

The structure wherein the supporting member 20 is left untouched when the cartridge 30 is inserted into or drawn out from the apparatus main body has an advantage that heater 201, heat pipe 202, lead wire 203 actuating LEDs and optics systems 12(Y), 12(M), 12(C) and 12(K) can be affixed on the supporting member 20 even when the photoreceptor is rotated or is mounted or dismounted. It is further possible to use that structure to determine an axis of photoreceptor drum 10.

When inserting, the cartridge 30 is placed on the aforementioned holder 50 that is composed of side plate 50A and a pair of supporting frames 50B so that the cartridge may be locked on the holder, and the holder is slid in the horizontal direction along guide rail 51 provided inside the apparatus main body.

When inserting the holder 50 into the apparatus, guide pin 30P supporting photoreceptor drum 10 in cartridge 30 is engaged with supporting member 20 to which exposure optics systems 12(Y), 12(M), 12(C) and 12(K) are attached, and almost simultaneously, flange 10B is engaged with guide rollers 40R on the side of the aforementioned base plate 40, then side plate 50A is brought into close contact with stopper portion 53 of the apparatus main body and affixed with set screws 52 which are used as an affixing means. Thus, the axis of the photoreceptor drum 10 and the center position in the axial direction for an image forming portion are determined.

When the holder 50 is drawn out of the apparatus for dismounting thereof, the action for sliding the holder is stopped when the photoreceptor drum 10 comes to the position where it is separated from the supporting member 20 to which the exposure optics system 12(Y), 12(M), 12(C) and 12(K) are attached, and the holder is caused to be in the state of being supported by guide rail 51.

The flange 10B of the photoreceptor drum 10 that is disengaged from the guide rollers 40R provided on the base plate 40 when the holder 50 is drawn out can be supported by several cuffs 30T formed solidly with the cartridge 30, and thereby the center of the axis of the photoreceptor drum 10 can be kept at the position which is identical to that for inserting the holder 50. Therefore, when the holder 50 is inserted again, the flange 10B can easily be engaged with the guide rollers 40R so that the photoreceptor drum 10 may be set to the correct axial position.

EXAMPLE

An example of the invention will be explained as follows, referring to FIG. 4.

Since exposure optics systems 12(Y), 12(M), 12(C) and 12(K) are positioned inside the photoreceptor drum 10, even when a diameter of the drum is relatively small, charging units 11(Y), 11(M), 11(C) and 11(K) and developing units 13(Y), 13(M), 13(C) and 13(K) can be arranged around the outer circumferential surface of the drum, thus, it is possible to make the volume of an apparatus to be compact by using a drum having a small diameter of 60–160 mm.

Figure 4:
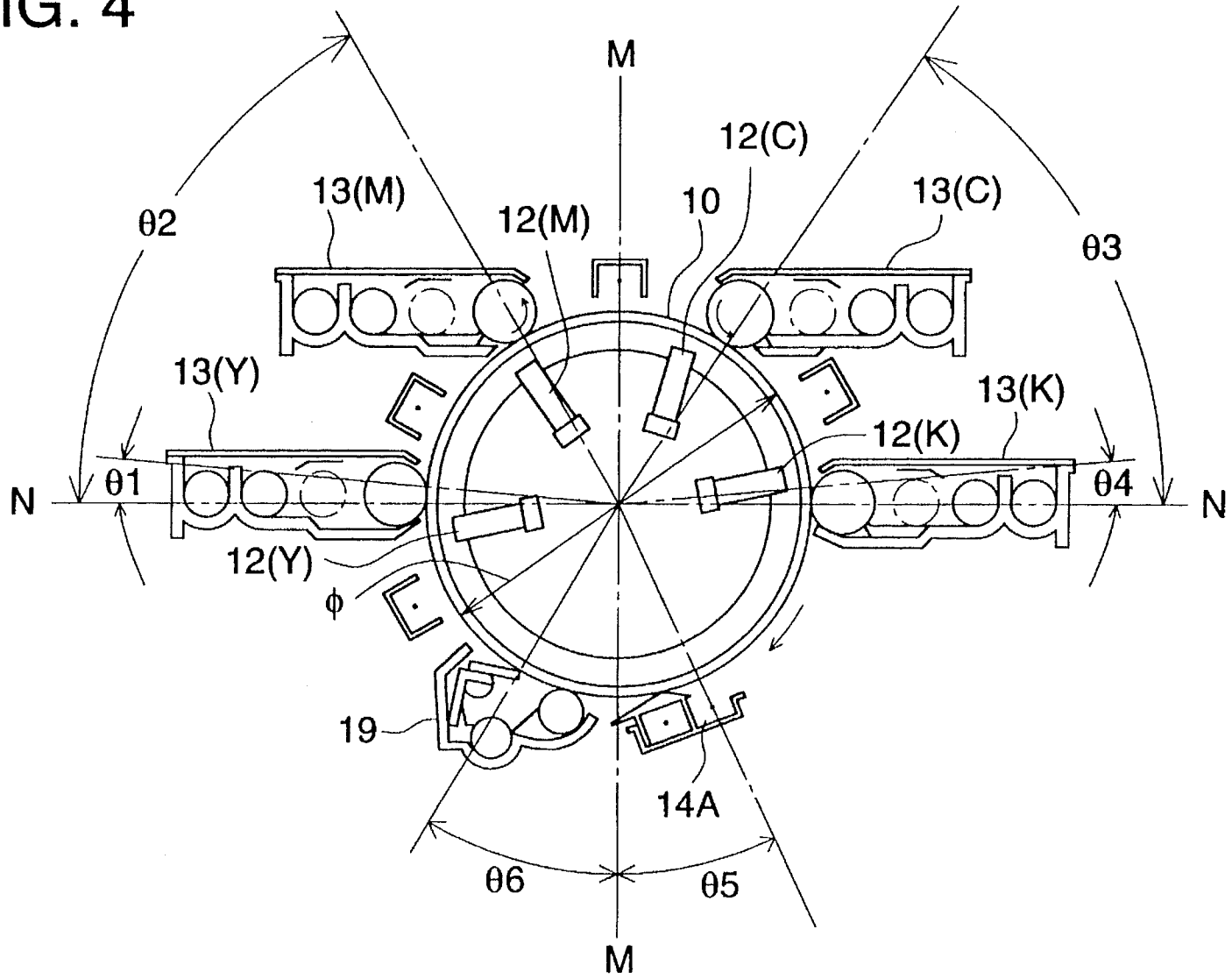
FIG. 4 is an arrangement plan showing a layout in the cartridge.

Further, in the arrangement wherein two of exposure optics systems 12(Y), 12(M), 12(C) and 12(K) and two of developing units 13(Y), 13(M), 13(C) and 13(K) are arranged on the left side of vertical line M—M passing through the center of the photoreceptor drum 10 with that vertical line as an axis of symmetry, while the other two of the exposure optics systems 12(Y), 12(M), 12(C) and 12(K) and the other two of the developing units 13(Y), 13(M), 13(C) and 13(K) are arranged on the right side thereof, transfer unit 14A is arranged on one side under horizontal line N—N passing through the center of the photoreceptor drum 10, and cleaning unit 19 is arranged on the other side thereof, as shown in FIG. 4, the cartridge 30 can be well balanced between its right and left to be handled extremely easily.

It was confirmed in the present example that the circumference of the photoreceptor can be utilized effectively and a layout which is balanced in terms of external shape and is balanced vertically can be obtained through the method wherein two of exposure optics systems 12(Y), 12(M), 12(C) and 12(K) and two of developing units 13(Y), 13(M), 13(C) and 13(K) are positioned on the left side of vertical line M—M, while the other two of the exposure optics systems 12(Y), 12(M), 12(C) and 12(K) and the other two of the developing units 13(Y), 13(M), 13(C) and 13(K) are positioned on the right side thereof to face those on the left side, and transfer unit 14A, cleaning unit 19 and developing units 13(Y), 13(M), 13(C) and 13(K) are positioned so that the following conditions are satisfied;

θ1 is within a range of ±20° for horizontal line N—N

θ2 is within a range from 45° to 75°

θ3 is within a range from 45° to 75°

θ4 is within a range of ±20° for horizontal line N—N

θ5 is within a range from 5° to 40°

θ6 is within a range from 10° to 50° where θ1 and θ4 represent respectively an angle between horizontal line N—N and a line connecting the center of the developing sleeve of the developing unit 13(Y) and an angle between horizontal line N—N and a line connecting the center of the developing sleeve of the developing unit 13(K) both arranged on the upper side to be a pair at right and left, θ2 and θ3 represent respectively angles for developing units 13(M) and 13(C) both arranged on the upper side to be a pair at right and left, θ5 represents an angle between vertical line M—M and a line connecting the center of the photoreceptor drum to the center of a transfer position of the transfer unit 14A at the upstream side in the rotation of the photoreceptor drum 10 with respect to the vertical line M—M under horizontal line N—N, and θ6 represents an angle between vertical line M—M and a line connecting the center of the photoreceptor drum to the point where cleaning unit 19 is in contact with the photoreceptor drum at the downstream side in the rotation of the photoreceptor drum 10 with respect to the vertical line M—M under horizontal line N—N. Incidentally, a transfer roller or a transfer belt can also be used in place of the transfer unit 14A. In this case, the area where the transfer roller or the transfer belt is in contact with a photoreceptor belt is defined to be the transfer position.

(Example 2)

Another example will be explained as follows, referring to FIG. 5.

Figure 5:
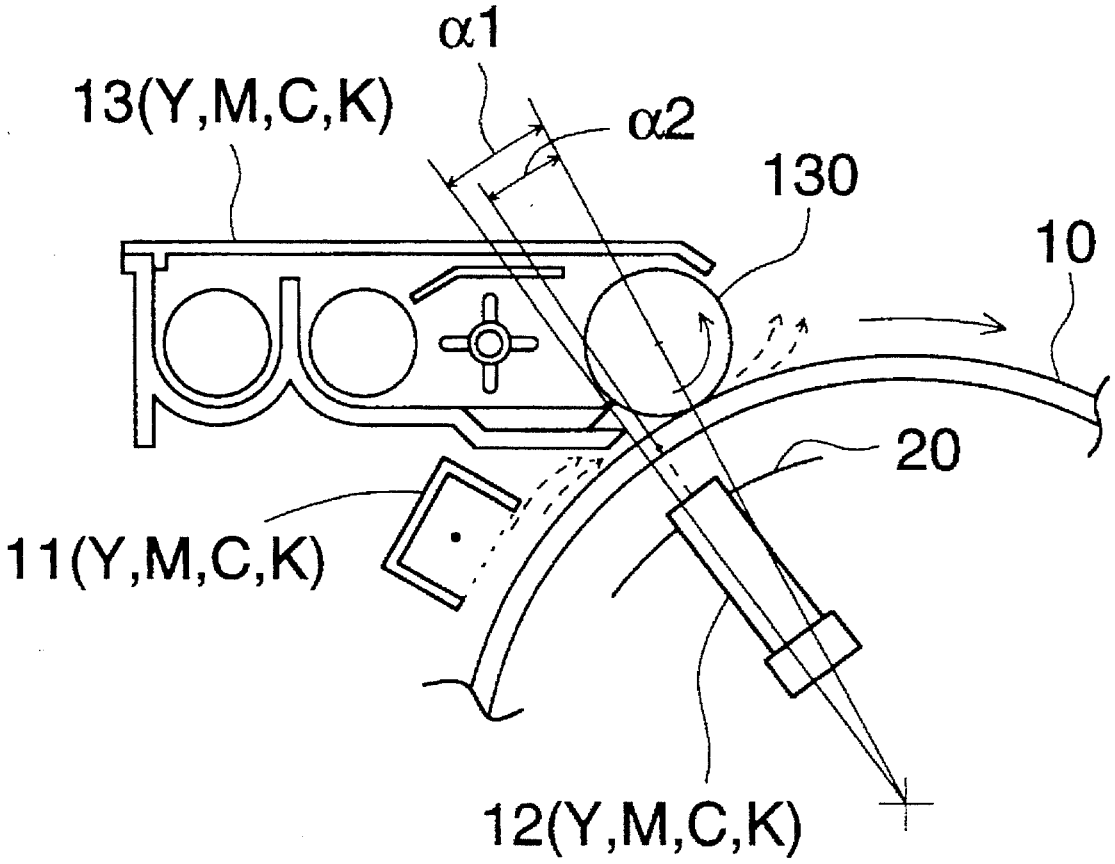
FIG. 5 is an illustration showing an imagewise exposure position.

Each exposure optics system 12 (Y, M, C and K) mentioned above is positioned so that it faces the position which is the most upstream side with respect to the rotation of the photoreceptor drum 10 within a range of the inside of a developer container of developing unit 13 (Y, M, C and K), namely it faces the drum surface that is close to an entrance in the developer container as shown in FIG. 5 so that imagewise exposure may be carried out immediately after the photoreceptor drum 10 that is given potential by charging unit 11 (Y, M, C and K) faces the container of each developing unit 13 (Y, M, C and K).

Each developing units 13 (Y, M, C and K) has an effect to suck an air layer on the drum surface into the developing unit container as shown with broken lines as the photoreceptor drum 10 rotates. Therefore, toner scattering to or toner sticking to the drum surface at the position of imagewise exposure or to charging units 11 (Y, M, C and K) can be prevented in advance, and thereby an electrostatic image with high image quality can be formed through impression of high voltage by means of the charging units 11 (Y, M, C and K) and imagewise exposure by means of exposure optics systems 12 (Y, M, C and K). On the other hand, the charging units 11 (Y, M, C and K) and developing units 13 (Y, M, C and K) can be arranged to be close each other, thus a diameter of the photoreceptor drum 10 can be made small. Further, when the direction of rotation of developing sleeve 130 is made identical to that of the photoreceptor, the above-mentioned effect can further be improved.

In accordance with the present example, when assuming that an outer diameter of photoreceptor drum 10 is r, a central angle of the photoreceptor drum 10 from an inlet of a developing container to the center of developing sleeve 130 that is the center of an developing area is α1, and a central angle between exposure optics systems 12 (Y, M, C and K) and developing sleeve 130 is α2, it was confirmed that an appropriate exposure position of the exposure optics systems 12 (Y, M, C and K) is located at the upstream side of the developing area where development of the photoreceptor is substantially carried out, and the position wherein the distance between the exposure optics systems 12 (Y, M, C and K) and developing sleeve 130 satisfies the condition of $$(2/3)\times\alpha 1\times r<\alpha 2\times r<\alpha 1\times r$$

for the distance from the inlet of the developing container to the center of the developing sleeve 130, can offer the most remarkable effect and can realize that toner scattering caused by imagewise exposure is eliminated and time required for the voltage of the photoreceptor drum 10 to fall is secured during a period from the imagewise exposure to the arrival at the developing area.

(Example 3)

Figure 6:
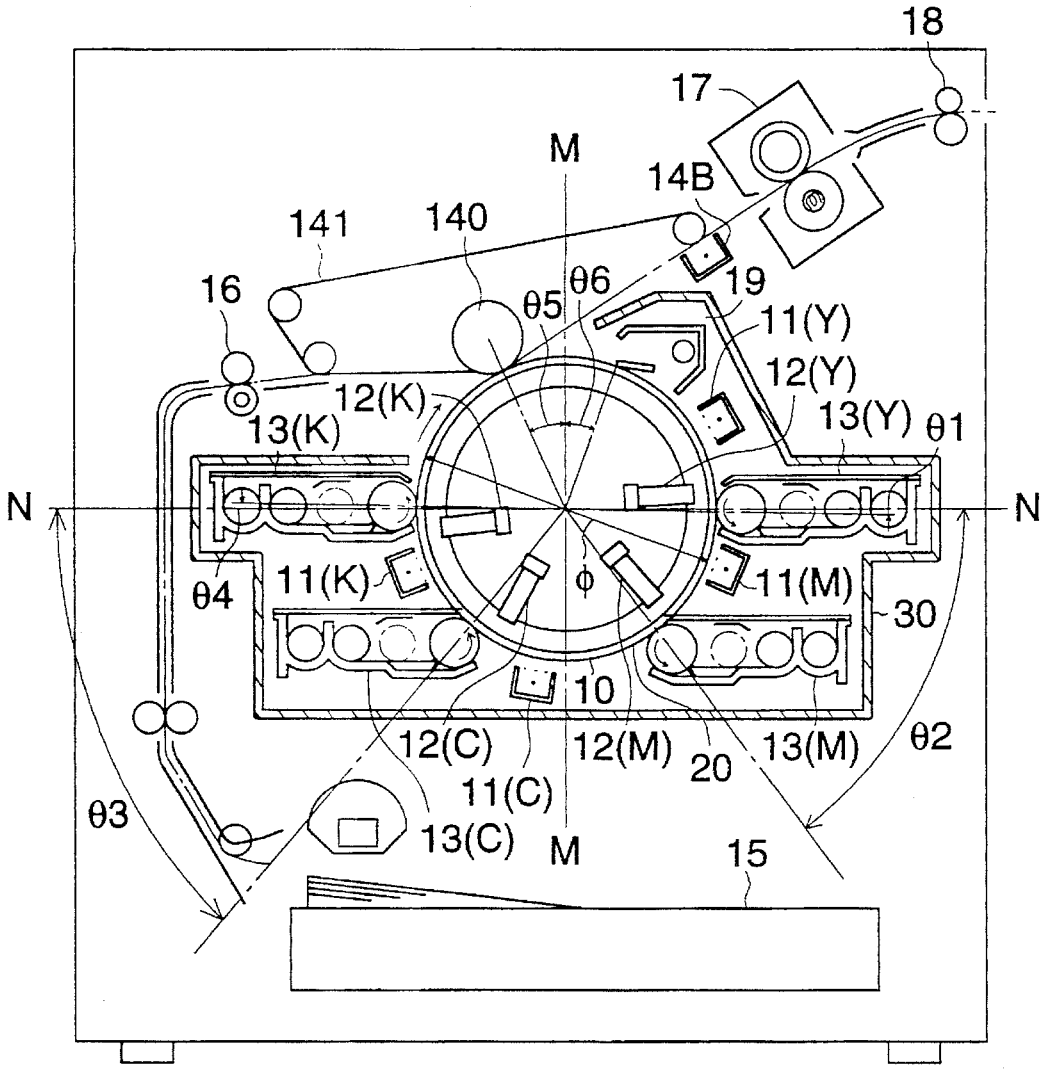
FIG. 6 is a sectional view showing the structure of a color image forming apparatus in accordance with the third embodiment for attaining the first object of the invention.

Still another example will be explained as follows, referring to FIG. 6.

The apparatus of the invention is of a type wherein a transfer means composed of pressure roller 140 and transfer belt 141 conveyed and rotated by the pressure roller 140 is provided at the upper portion of the apparatus, and toner images are transferred, through the pressure roller 140, onto a transfer sheet that is attracted and conveyed by the transfer belt 141, at the position over the photoreceptor drum 10.

Even in the case of the present apparatus, photoreceptor drum 10 can be provided on its external circumferential surface with the aforementioned plural charging units 11(Y), 11(M), 11(C) and 11(K), developing units 13(Y), 13(M), 13(C) and 13(K) and others despite a relatively small diameter of the drum because exposure optics systems 12(Y), 12(M), 12(C) and 12(K) are housed inside the photoreceptor drum 10. Practically, outer diameter $\phi$ of 60 mm is enough and a drum with a large diameter of 160 mm or more is not needed, which makes an apparatus to be of small size.

When two each of exposure optics systems 12 (Y, M, C and K) and developing units 13 (Y, M, C and K) are arranged on each of the left and right sides about the symmetrical axis of vertical line M—M passing through the center of the photoreceptor drum 10, and pressure roller 140 is arranged on one side of horizontal line N—N passing through the center of the photoreceptor drum 10 while cleaning unit 19 is arranged on the other side thereof, cartridge 30 can be balanced and it offers easy operation.

After making sure on the present example, it was possible to use the surrounding of the photoreceptor effectively and to obtain the layout wherein an external shape and superimposing are balanced, under the conditions that angles $\theta 1$ and $\theta 4$ formed respectively between horizontal line N—N and the center of developing sleeve of developing unit 13(Y) and between horizontal line N—N and the center of developing sleeve of developing unit 13(K) both developing units being a pair of developing units at right and left are within 20° respectively upward and downward, angles $\theta 2$ and $\theta 3$ formed respectively for a pair of developing unit 13(M) and developing unit 13(C) at right and left arranged at further lower positions are respectively within a range of 45° and 75°, angle $\theta 5$ formed between the center of the pressure roller 140 and vertical line M—M at the upstream side of the photoreceptor drum 10 over horizontal line N—N is 5°–40°, and angle $\theta 6$ formed between the contact point of cleaning unit 19 and vertical line M—M at the downstream side of the photoreceptor drum 10 over horizontal line N—N is 10°–50°.

In the invention, even in the case of a color image forming apparatus of a type wherein exposure means are housed in an image forming object, the image forming object can be integrated solidly in a cartridge together with a charging means and a developing means with well-balanced layout as in the case of an ordinary apparatus, and thereby the cartridge can be mounted on or dismounted from the apparatus main body through easy operation and high accuracy. As a result, it has become possible to provide a small-sized color image forming apparatus which can print at high speed and requires easy operation for maintenance.

Next, examples 4–6 for attaining the second object of the invention will be explained as follows, referring to FIGS. 7, 8 through 10(*e*). The examples have the same constitution as in FIGS. 1 and 2 which have been explained already, and different points are as follows.

(Example 4)

Figure 7:
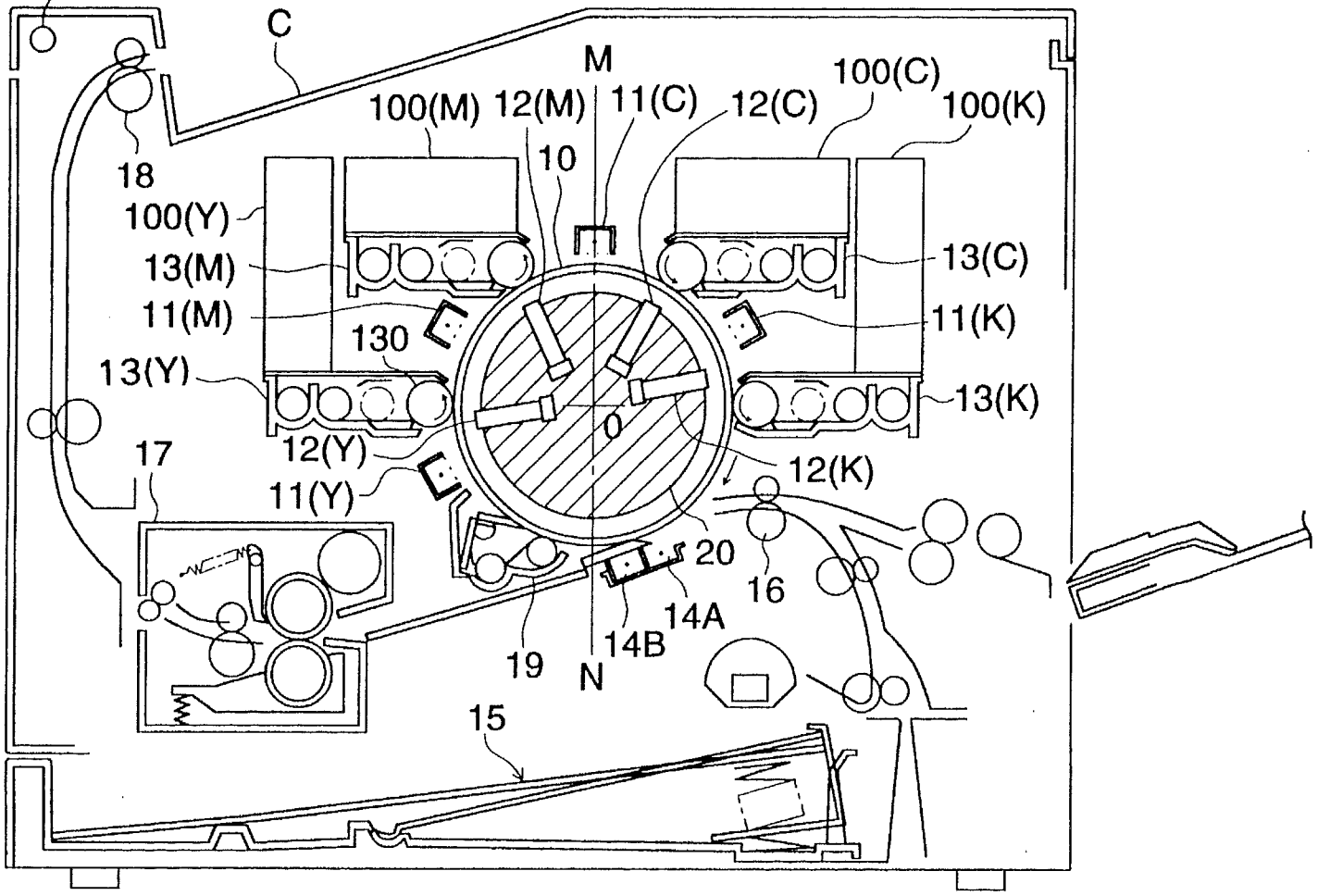
FIG. 7 is a sectional structure diagram of a color image forming apparatus for attaining the second object of the invention.

With regard to each developing unit shown in FIG. 7, developing unit 13(M) and developing unit 13(Y) are arranged vertically on the left side of vertical line M-O-N passing through the center of photoreceptor drum 10, while developing unit 13(C) and developing unit 13(K) are arranged vertically on the right side, and toner hoppers 100(M), 100(Y), 100(C) and 100(K) which are connected respectively to the developing units are arranged so that top faces of the toner hoppers are on the same level and two each of the toner hoppers are symmetrical about the vertical line M-O-N.

By making the toner hoppers 100(Y) and 100(K) to be vertical and making the toner hoppers 100(M) and 100(C) to be horizontal, it is possible to utilize the upper space of the developing unit effectively and to make all toner hoppers to have large and equal capacity.

When top cover C of the apparatus main body is opened counterclockwise with supporting shaft H as a fulcrum and held, upper faces of the aforesaid toner hoppers are opened widely. Therefore, it is possible to approach each toner hopper to it with toner easily, safely and directly, without causing toner to flow out.

It is also possible to arrange so that toner is supplied to each of toner hoppers 100(Y), 100(M), 100(C) and 100(K) from the upper portion of cartridge 30 after the cartridge 30 is drawn out toward the front side in the figure. In this case, a fear that toner scatters and soils the inside of the apparatus can be avoided because toner is supplied outside the apparatus main body.

Figure 8:
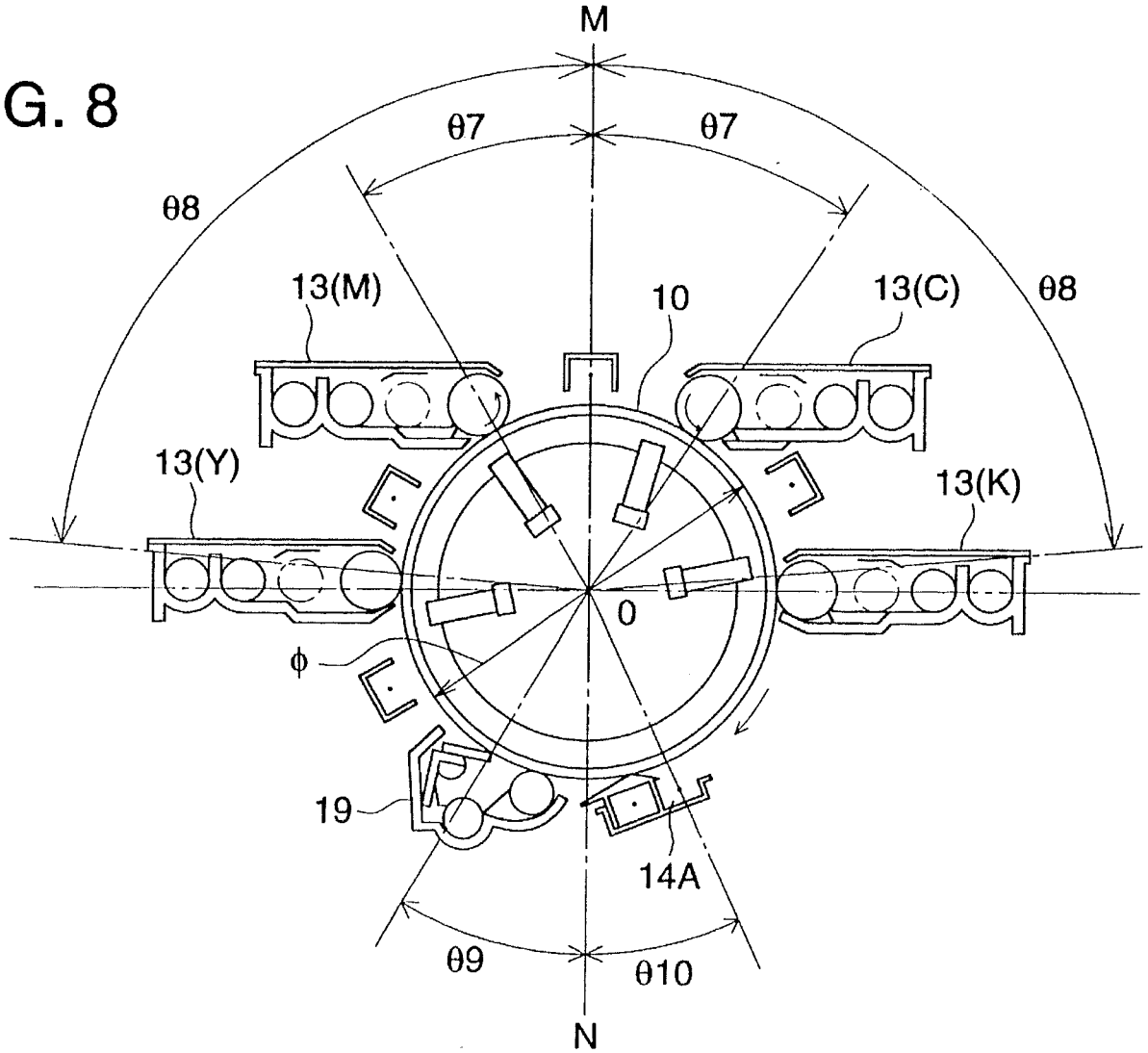
FIG. 8 is an arrangement plan of an image forming section of the apparatus mentioned above.

Further, it is possible to utilize effectively the space around the photoreceptor drum and to obtain a layout which is compact and balanced in terms of shape and weight distribution through an arrangement wherein developing units 13(M) and 13(C) are positioned respectively on the left side and right side, namely at the upstream side and downstream side of upper vertical line M-O at the upper portion of the photoreceptor drum 10 in terms of drum rotation so that angle 87 may be within a range of 25°–45°, developing units 13(Y) and 13(K) are positioned respectively at the upstream side and downstream side in terms of drum rotation so that angle $\theta 8$ may be within a range of 75°–105°, cleaning unit 19 is positioned at the downstream side of lower vertical line O-N in terms of drum rotation so that angle 89 may be within a range of 5°–45° and transfer unit 14A is positioned at the upstream side in terms of drum rotation so that angle $\theta 10$ may be within a range of 5°–45° as shown in FIG. 8.

Therefore, an image forming section of the present apparatus which is compact and is easy to be operated can be housed in process cartridge 30 to be mounted on or dismounted from the apparatus main body solidly with the process cartridge.

Figure 9:
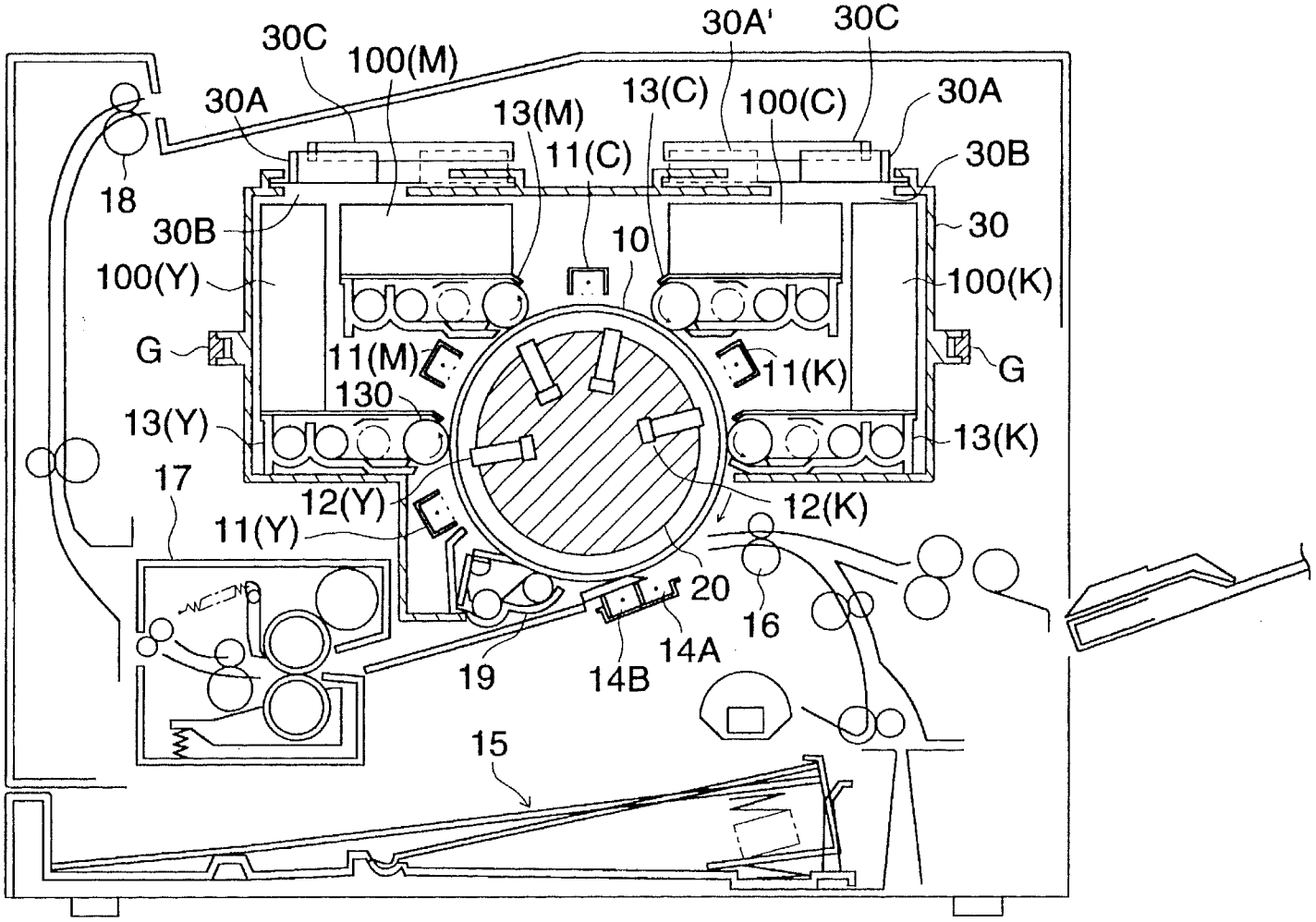
FIG. 9 is a structural diagram of a process cartridge in the apparatus mentioned above.

FIG. 9 shows another type wherein toner can be supplied only when a cartridge is mounted on an image forming apparatus.

FIG. 9 shows a state wherein process cartridge 30 is mounted on the main body, and shielding plate 30A is so structured as to slide along shielding plate guide 30C to be at the position of 30A'. The process cartridge 30 housing therein the aforesaid photoreceptor drum 10, charging units 11(Y), 11(M), 11(C) and 11(K), developing units 13(Y), 13(M), 13(C) and 13(K), toner hoppers 100(Y), 100(M), 100(C) and 100(K) and cleaning unit 19 can be inserted into or drawn out of the apparatus main body in the direction perpendicular to the figure plane, leaving in the apparatus main body the supporting member 20 on which exposure optics systems 12(Y), 12(M), 12(C) and 12(K) are attached.

When inserting the process cartridge 30, the photoreceptor drum 10 is guided to be positioned at the prescribed location without giving any load or shock to the aforesaid exposure optics systems 12(Y), 12(M), 12(C) and 12(K) are attached.

Figure 14:
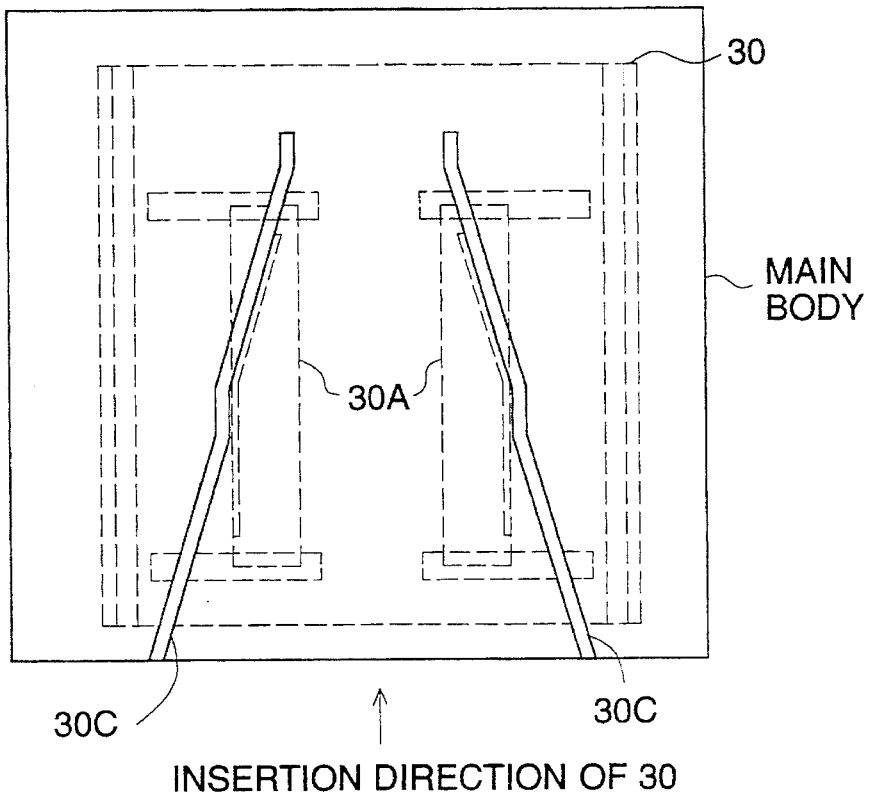
FIGS. 14(*a*) and 14(*b*) represent top view 14(*b*) of process cartridge and top view 14(*a*) of the same mounted on the main body.
Figure 14:
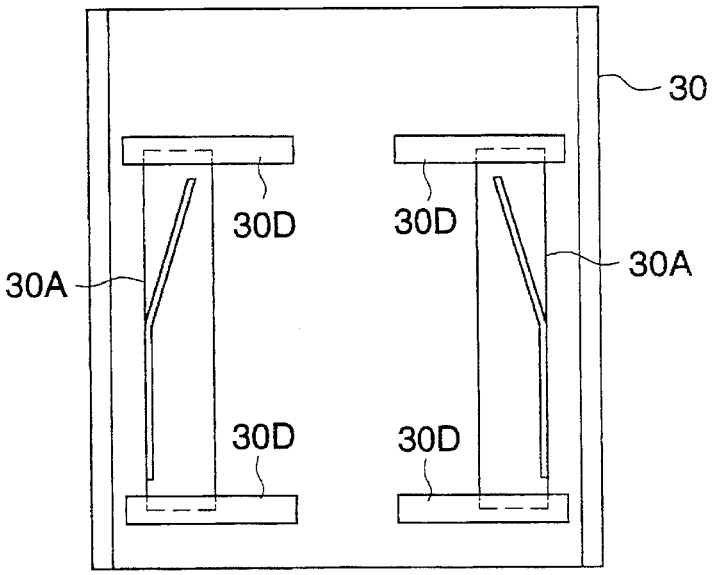

FIG. 14(*a*) is a plan view wherein process cartridge 30 is in the apparatus main body, and FIG. 14(*b*) is a plan view of the process cartridge 30. Shielding plate 30A is movable along rail 30D, and it is in the state to close opening 30B when the process cartridge 30 is not inserted. When the process cartridge 30 is inserted in the apparatus main body in the arrowed direction in FIG. 14(*a*), the shielding plate 30A is moved along the rail 30D by the shielding plate guide 30C, and the opening 30B is opened accordingly. Namely, the process cartridge 30 is provided on its top surface with shielding plate 30A that is slidable and is urged in the horizontal direction on the figure plane by an elastic member for covering a toner supply inlet. When the process cartridge 30 is in the state wherein it is mounted on the apparatus, each shielding plate 30A touches the shielding plate guide 30C of the apparatus main body and slides to open the opening 30B on the top surface of the process cartridge 30 so that toner can be supplied to each of toner hoppers 100(Y), 100(M), 100(C) and 100(K). When the process cartridge 30 is drawn out, the aforesaid each shielding plate 30A slides in the direction opposite to that of the processing cartridge being urged by the elastic member, and it closes each opening 30B mentioned above so that toner can not be supplied to each of the toner hoppers 100(Y), 100(M), 100(C) and 100(K) .

Figure 10:
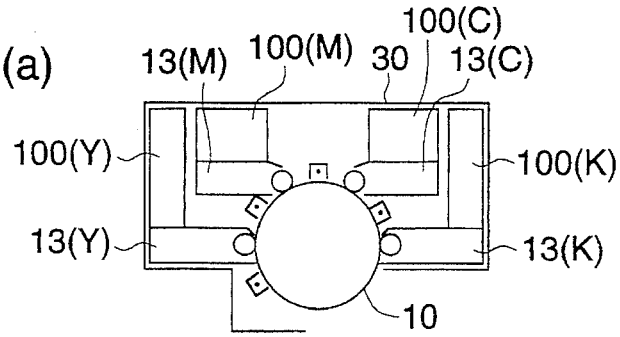
FIGS. 10(*a*)–10(*e*) each represent a layout diagram in the process cartridge.
Figure 10:
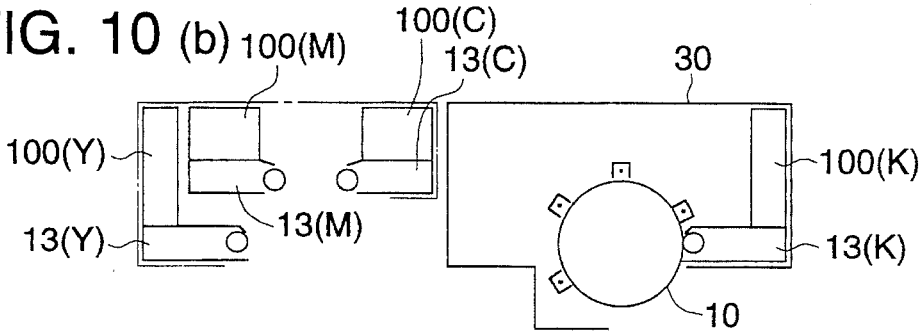
Figure 10:
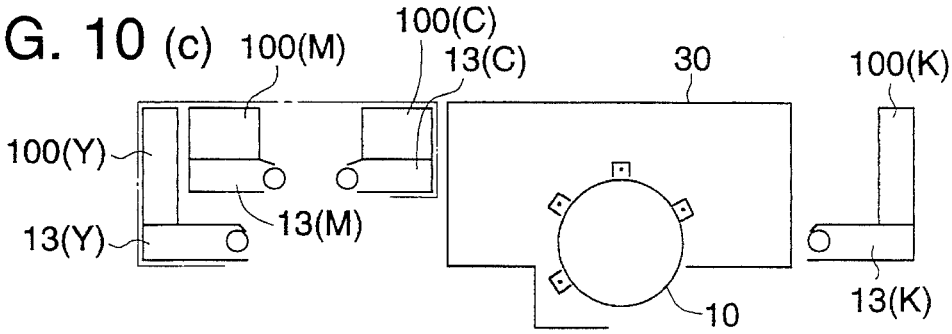
Figure 10:
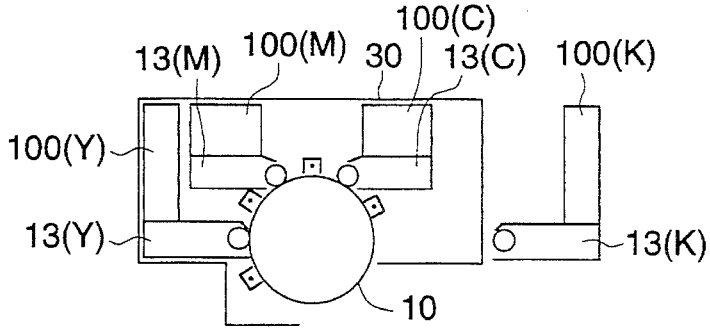
Figure 10:
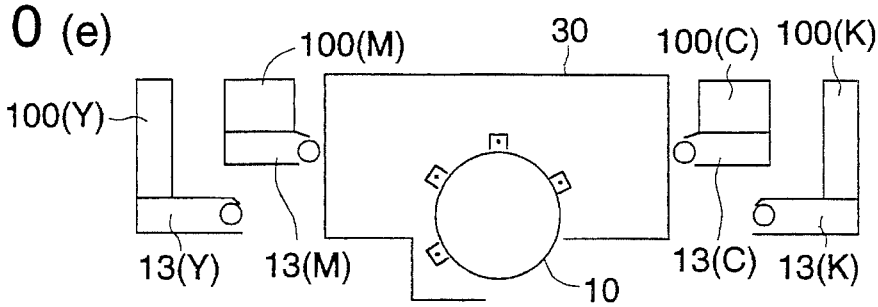

Photoreceptor drum 10, developing units 13(Y), 13(M), 13(C) and 13(K) and toner hoppers 100(Y), 100(M), 100(C) and 100(K) all housed in the process cartridge 30 are affixed in the cartridge as shown in FIG. 10(*a*), and they are replaced simultaneously at the expiration of their term of service. However, it is also possible to arrange so that each unit is made to be a block and is inserted in or taken out of the cartridge so that it can be replaced individually depending on how frequently it is used.

FIG. 10(*b*) shows an example wherein each unit of developing units 13(Y), 13(M), 13(C) and 13(K) and toner hoppers 100(Y), 100(M), 100(C) and 100(K) is made to be a block, and photoreceptor drum 10, developing unit 13(K) and toner hopper 100(K) all having a short service life can be replaced together with cartridge 30. FIG. 10(*c*) shows an example wherein each unit of developing unit 30(K) and toner hopper 100(K) both are used more frequently than in the aforesaid cartridge 30 can be replaced.

In an apparatus wherein the aforesaid units of developing unit 30(K) and toner hopper 100(K) are used especially frequently, it is preferable to arrange so that such units can be taken out individually from the cartridge 30 as shown in FIG. 10(*d*). On the other hand, in an apparatus wherein toner hoppers 100(Y), 100(M), 100(C) and 100(K) used frequently can not be identified, it is preferable that each unit of the developing units 13(Y), 13(M), 13(C) and 13(K) and toner hoppers 100(Y), 100(M), 100(C) and 100(K) can be taken out separately.

(Example 5)

Other examples will be explained as follows, referring to FIGS. 11(*a*), 11(*b*), 12(*a*) and 12(*b*).

Incidentally, in the invention, an arrangement in FIG. 7 wherein toner hoppers 100(Y), 100(M), 100(C) and 100(K) are provided in parallel is a preferable arrangement because when cover C is opened, toner hoppers provided in parallel are exposed and thereby each toner hopper can be replaced easily from the upper portion.

Each of the aforesaid developing units 13(Y), 13(M), 13(C) and 13(K) is equipped with developing sleeve 130, layer thickness regulating member 131 for developing agent, supply roller 132 and stirring screws 133 and 134 each rotating in the opposite direction each other, and funnel-shaped toner supply inlet 13A is opened at the upper portion on the end of the aforesaid stirring screw 134.

Figure 11:
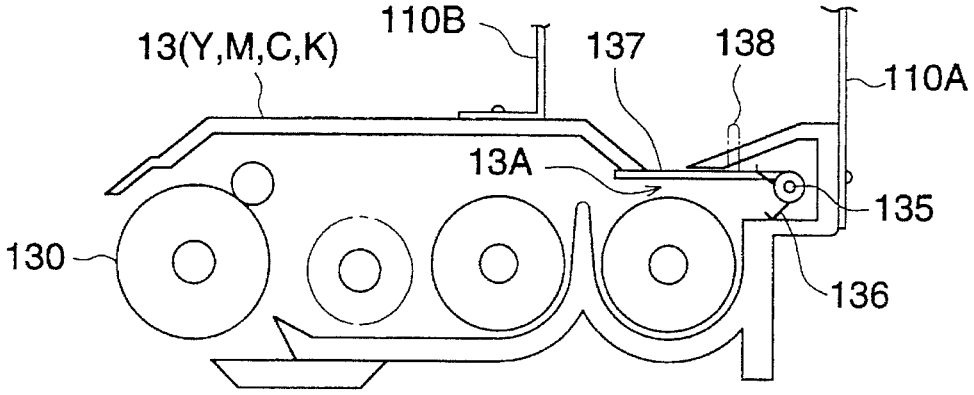
FIGS. 11(*a*) and 11(*b*) and each represent a sectional view showing how a toner hopper is mounted on a developing unit.
Figure 11:
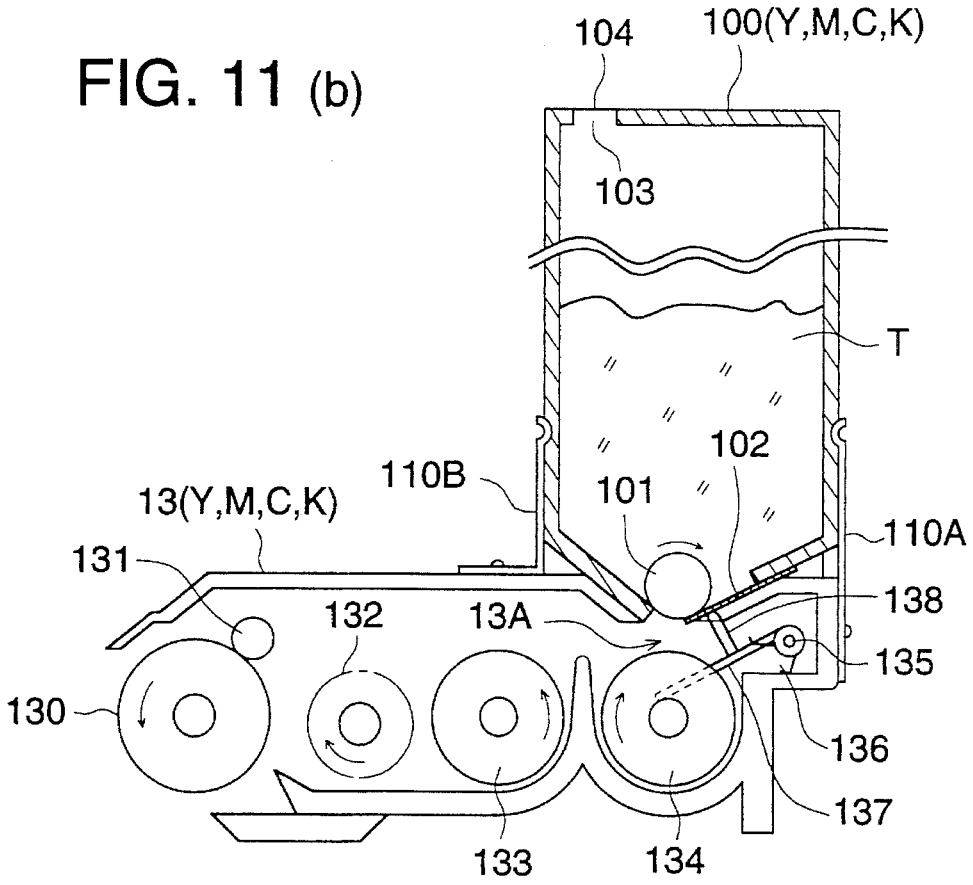

On the bottom surface of the toner supply inlet 13A, there is provided cover plate 137 that is urged clockwise by coil spring 136 with shaft 135 as a fulcrum, and the cover plate 137 closes the toner supply inlet 13A from inside thereof with pressure pin 138 provided on the upper surface of the cover plate protruding upward on the developing container as shown in FIG. 11(*a*).

On the other hand, as shown in FIG. 11(*b*), each of the toner hoppers 100(Y, M, C and K) is provided on its opening at the container bottom with supply roller 101 made of sponge-like elastic object and elastic plate 102 made of metal sheet as an elastic member being in pressure contact with the supply roller 101, and toner T contained therein is squeezed out by a rotation of the supply roller 101 to be supplied through the opening.

Toner T contained in each of the toner hoppers 100(Y, M, C and K) is packed through either one of the following two ways: in one way, toner is filled in the container through the opening at the bottom of the container and then the elastic plate 102 that is an elastic member is stuck on the container, and in the other way, toner-filling inlet 103 is provided on the top of the container through which toner is filled after the elastic plate 102 is stuck on the container and then seal 104 is applied on the container.

Each of the toner hoppers 100(Y, M, C and K) is inserted between elastic hopper supporting plates 110A and 110B provided on each of developing units 13(Y, M, C and K) and is connected to each of developing units 13(Y, M, C and K) through holding of the hopper supporting plates, thus the pressure pin 138 is pressed by the elastic plate 102 to rotate the cover plate 137 counterclockwise so that toner supply inlet 13A may be opened.

Concurrently with connection of each of toner hoppers 100(Y, M, C and K) to each of developing units 13(Y, M, C and K), a gear (not shown) provided on a rotary shaft of the supply roller 101 engages with a gear in the toner supply driving system, and toner supply signals make the supply roller 101 to rotate clockwise so that toner T may be supplied to toner supply inlet 13A of each of developing units 13(Y, M, C and K) and dropped to the end portion of the stirring screw 134.

Toner T dropped in the developing unit is conveyed to the other end portion by a thrust of the stirring screw 134, then is moved to the side of the stirring screw 133 across a partition wall and is mixed with existing developing agent while being conveyed to the opposite side by a thrust of the stirring screw 133.

When each of the developing units 13(Y, M, C and K) which is to be supplied with toner is out of its service life, each of the toner hoppers 100(Y, M, C and K) is prevented from being connected to the developing units so that wasteful toner supply can be avoided.

Toner hoppers 100(Y, M, C and K) are prevented from being connected to developing units 13(Y, M, C and K) in a way that an obstacle is protruded in the path of insertion for each of toner hoppers 100(Y, M, C and K) when the accumulated value of copy quantity made by that developing unit arrives at a prescribed value or when the predetermined period of usage has been passed.

Figure 12:
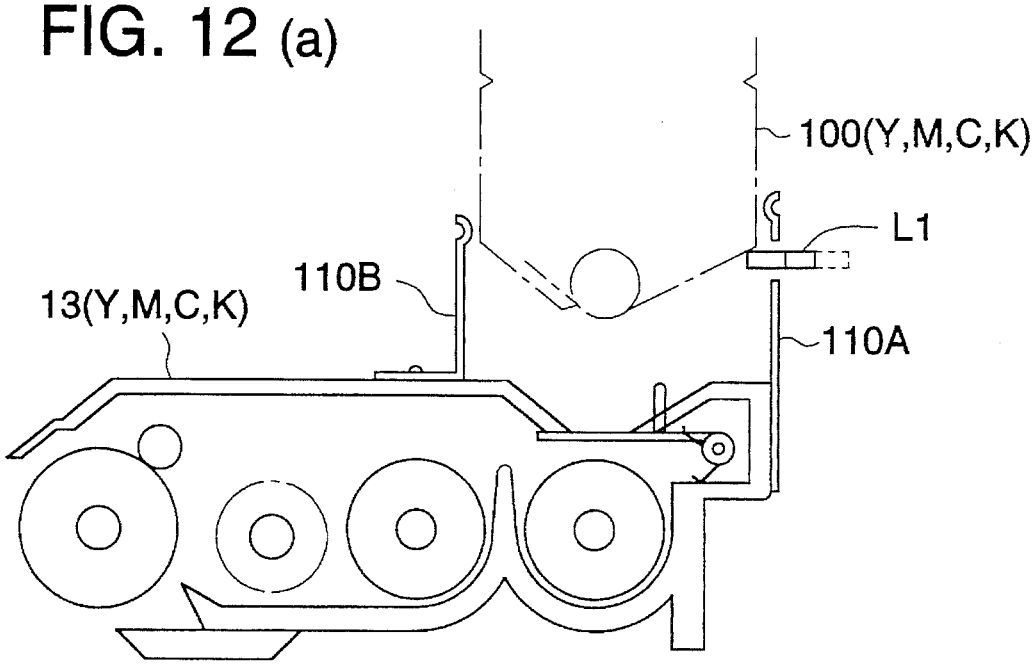
FIGS. 12(*a*) and 12(*b*) each represent a sectional view showing how the mounting of a toner hopper on the developing unit is restricted.
Figure 12:
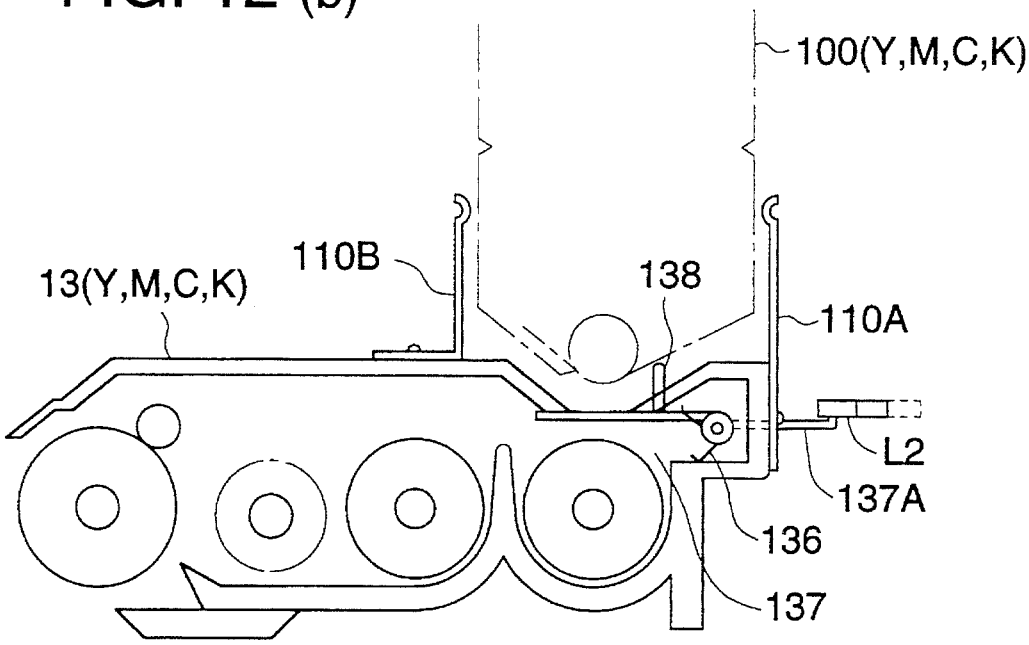

In the example shown in FIG. 12(*a*), lock member L1 is provided at the position where it does not interrupt hopper supporting plate 110A, and when developing units 13(Y, M, C and K) are within their service life, the lock member L1 is held at the position shown with broken lines to allow toner hoppers 100(Y, M, C and K) to be mounted, but when they are out of their service life, the lock member slides to the left to protrude through the hopper supporting plate 110A to its inside to prevent the toner hoppers 100(Y, M, C and K) from being mounted.

In the example shown in FIG. 12(*b*), lock member L2 is provided on the side of each of developing units 13(Y, M, C and K), and stopper plate 137A that rotates together with the cover plate 137 is provided outside the developing unit, in which the cover plate 137 is prevented from rotating and thereby pressure pin 138 prevents each of toner hoppers 100(Y, M, C and K) to be mounted.

(Example 6)

Figure 13:
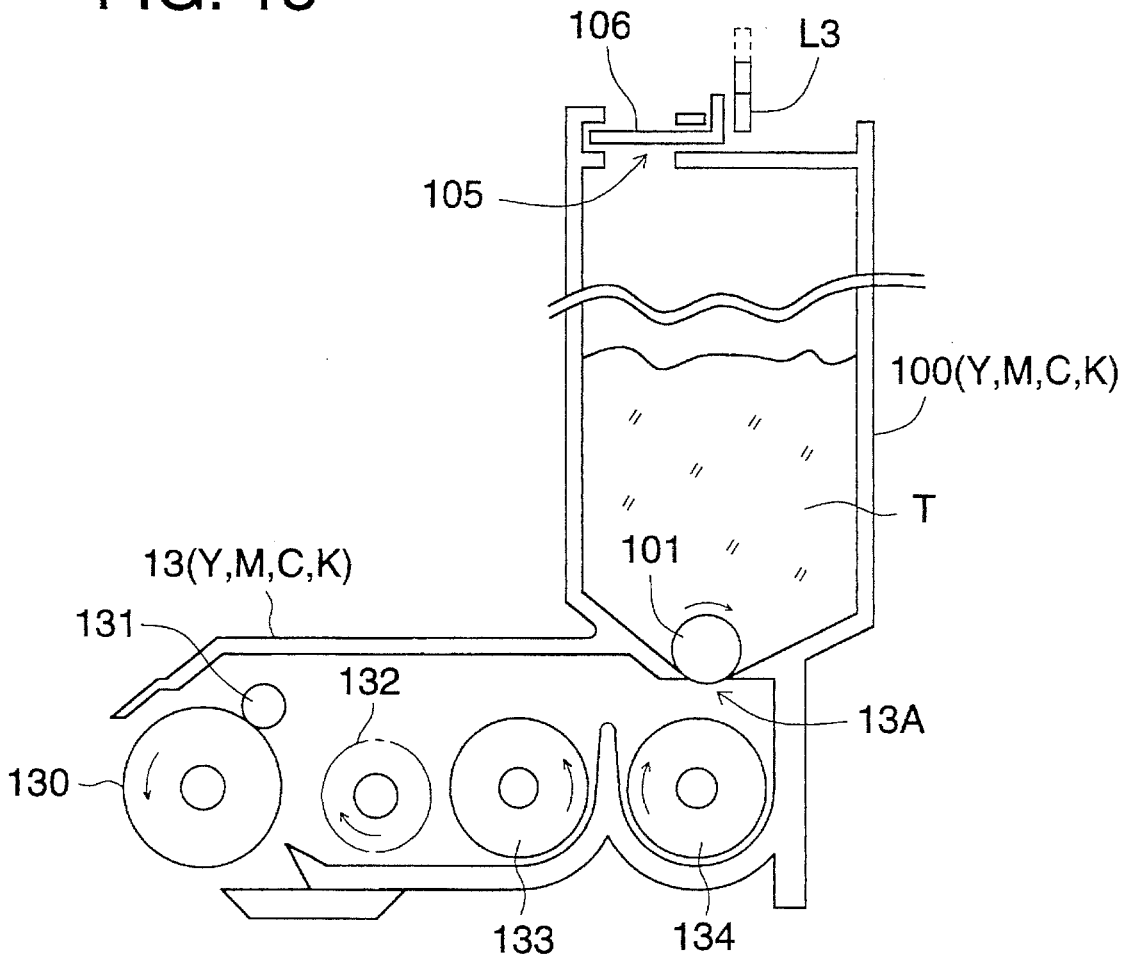
FIG. 13 is a sectional view showing how the toner supply to a toner hopper which is united with a developing unit is restricted.

Still another example will be explained as follows, referring to FIG. 13.

In the invention, the constitution wherein toner hoppers 100(Y, M, C and K) are arranged in parallel is especially preferable because the toner hoppers are exposed when cover C is opened and toner can easily be supplied to the toner hopper directly from the upper portion.

Each of the developing units 13(Y, M, C and K) is provided with developing sleeve 130, developer layer thickness regulating member 131, supply roller 132 and stirring screws 133 and 134 each rotating in the opposite direction each other, and each of the toner hoppers 100(Y, M, C and K) is provided at the upper part of the end portion of the stirring screw 134 to be formed solidly with the developing unit.

Each of the toner hoppers 100(Y, M, C and K) is provided with supply roller 101 made of sponge-like elastic object which is in pressure contact with toner supply inlet 13A that is located on the top surface of each container of the developing units 13(Y, M, C and K) as shown in the figure, and when the supply roller 101 is rotated, toner T contained in the toner hopper is supplied into each of the developing units 13(Y, M, C and K).

Toner T contained in each of the toner hoppers 100(Y, M, C and K) is filled therein through toner supply inlet 105 provided on the upper part of the toner hopper and is caused to be in the state of sealing in the container when slide-type shutter plate 106 is closed.

The toner supply roller 101 whose rotary shaft is provided with a gear (not shown) engaging with a gear in the toner supply driving system is rotated clockwise by the toner supply signal and drops toner T contained on the end portion of the stirring screw 134.

Toner T thus dropped in the developing unit is conveyed by a thrust of the stirring screw 134 to the end portion of the other side, then is moved to the side of the stirring screw 133 across a partition wall and is mixed with existing developing agent while being conveyed to the opposite side by a thrust of the stirring screw 133.

When each of the developing units 13(Y, M, C and K) which is united solidly to the toner hopper is out of its service life, each of the toner hoppers 100(Y, M, C and K) is prevented from being supplied with toner T from outside.

Supply of toner to each of toner hoppers 100(Y, M, C and K) is prevented by shutter plate 106 provided at the toner supply inlet 105 being made impossible to slide by protrusion of a stopper member when the accumulated value of copy quantity made by the developing unit united solidly with the toner hopper arrives at a prescribed value or when the predetermined period of usage has been passed.

Namely, lock member L3 is provided as the aforesaid stopper member at the upper portion of each of toner hoppers 100(Y, M, C and K) and when developing units 13(Y, M, C and K) are within their service life, the lock member is held at the position shown with broken lines to allow the shutter plate 106 to slide to the right side and thereby to open the toner supply inlet 105 but when they are out of their service life, the lock member descends to the position shown with solid lines to prevent the shutter plate 106 from sliding.

Though the aforesaid lock member L3 is positioned restrictively at the location on the apparatus main body where the lock member does not stand in the way of the developing unit when it is mounted or dismounted, it is also possible to provide the lock member on the developing unit. In that case, the position for providing the lock member can be determined freely without being limited because the developing unit is mounted or dismounted together with each of the toner hoppers 100(Y, M, C and K).

The invention has made it possible to locate compactly each toner hopper connected to each developing unit at the position where the toner hopper can simply be connected to a developing unit for mono-component or two-component developer and toner can easily be supplied to the toner hopper itself, even in the case of an image forming apparatus wherein a plurality of developing units are arranged dispersively around an image forming object. The invention has further realized a small-sized and high speed color image forming apparatus wherein supply of toner to a toner hopper can be controlled depending on a life of a developing unit.

Figure 15:
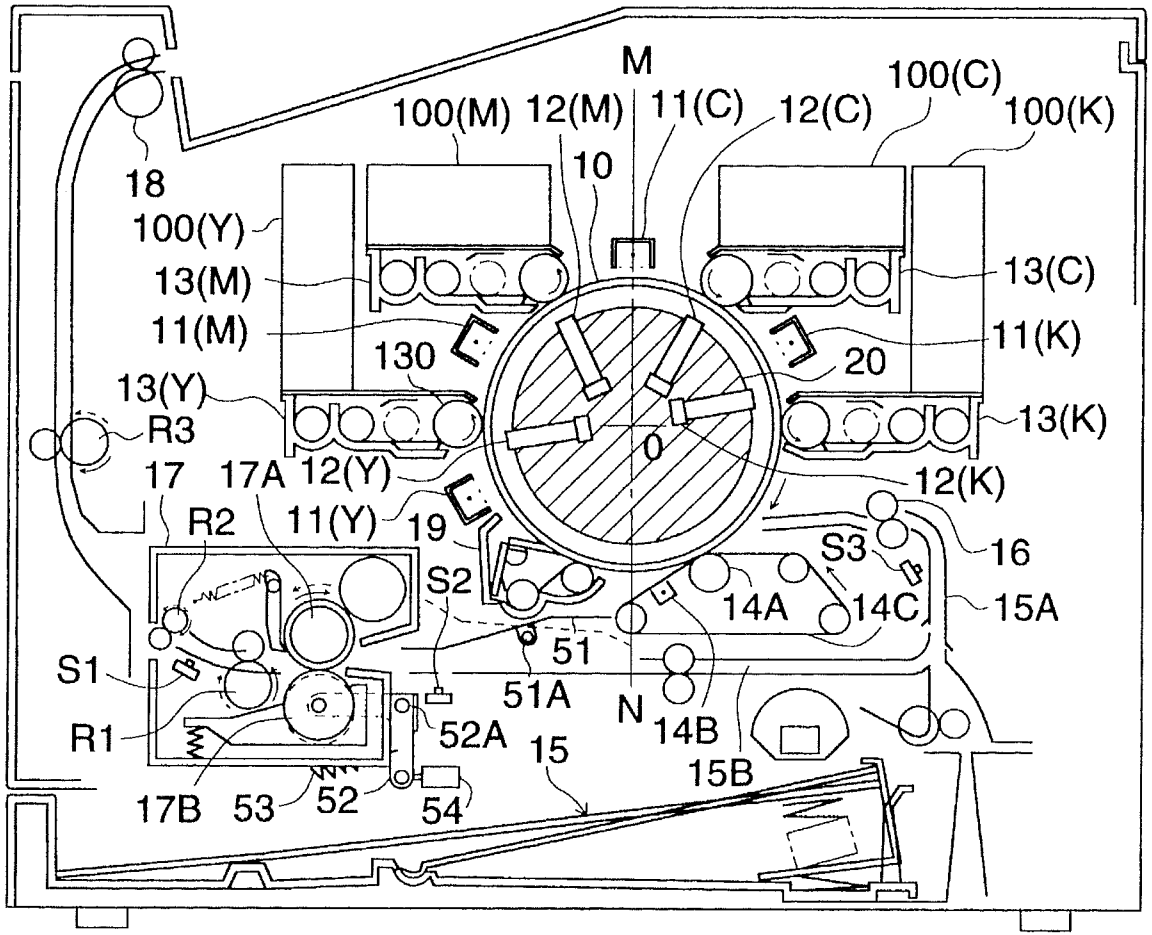
FIG. 15 is a sectional structure diagram of a two-sided color image forming apparatus in accordance with each embodiment for attaining the third object of the invention.

Prior to the explanation of examples 7–11 for attaining the third object of the invention, the structure of a duplex color image forming apparatus which is common to all examples will be explained as follows, referring to FIGS. 15 and 16. These examples have the structure and function which are the same as those in FIG. 9 which has already been explained, and different points are as follows.

A color toner image formed on the circumferential surface of photoreceptor drum 10 is transferred by transfer unit 14A onto a transfer sheet which is fed out of sheet feeding cassette 15 and conveyed while being synchronized by photosensor S3 and timing roller 16 after passing through sheet feeding path 15A.

When the one-sided copy mode is designated, a transfer sheet having thereon a transferred image is neutralized by neutralizing unit 14B and then is separated from the circumferential surface of the drum, conveyed by transfer belt 14C through guide member 51 to fixing unit 17 where toner on the transfer sheet is fused, and then conveyed by conveyance rollers R1, R2 and R3 onto an exit tray through exit roller 18.

On the other hand, when the duplex copy mode is designated, heat roller 17A and the conveyance rollers R1, R2 and R3 are all switched to rotate reversely by detection signals of photosensor S1 that detects the trailing edge of the transfer sheet that has passed fixing unit 17, and simultaneously with the foregoing, the guide member 51 rotates clockwise around the fulcrum of supporting shaft 51A to be in the position shown with broken lines.

Accordingly, the transfer sheet having on its one side a fixed toner image is conveyed reversely through the fixing unit 17, then is guided by the guide member 51 to pass through the sheet feeding path 15B and to pass through sheet feeding path 15A again, and is conveyed to the timing roller 16. In this case, the toner image is reversed to face downward, thereby a toner image is transferred onto the reverse side of the transfer sheet.

Prior to this, the heat roller 17A and the conveyance rollers R1, R2 and R3 are all returned to their regular rotation by detection signals of photosensor S2 that detects the trailing edge of the transfer sheet that has been conveyed to sheet feeding path 15B, and simultaneously with this, the guide member 51 is also returned to the position shown with solid lines.

Therefore, the toner image on the reverse side of the transfer sheet is fused by fixing unit 17, and then the transfer sheet is conveyed by the transfer rollers to an exit tray located at the upper portion of the apparatus through exit roller 18.

The sheet feeding path 15B can be structured within a space formed between the transfer roller 14A and sheet feeding cassette 15 without providing an additional space for the apparatus in particular. Therefore, the height of the apparatus does not need to be increased.

Figure 16:
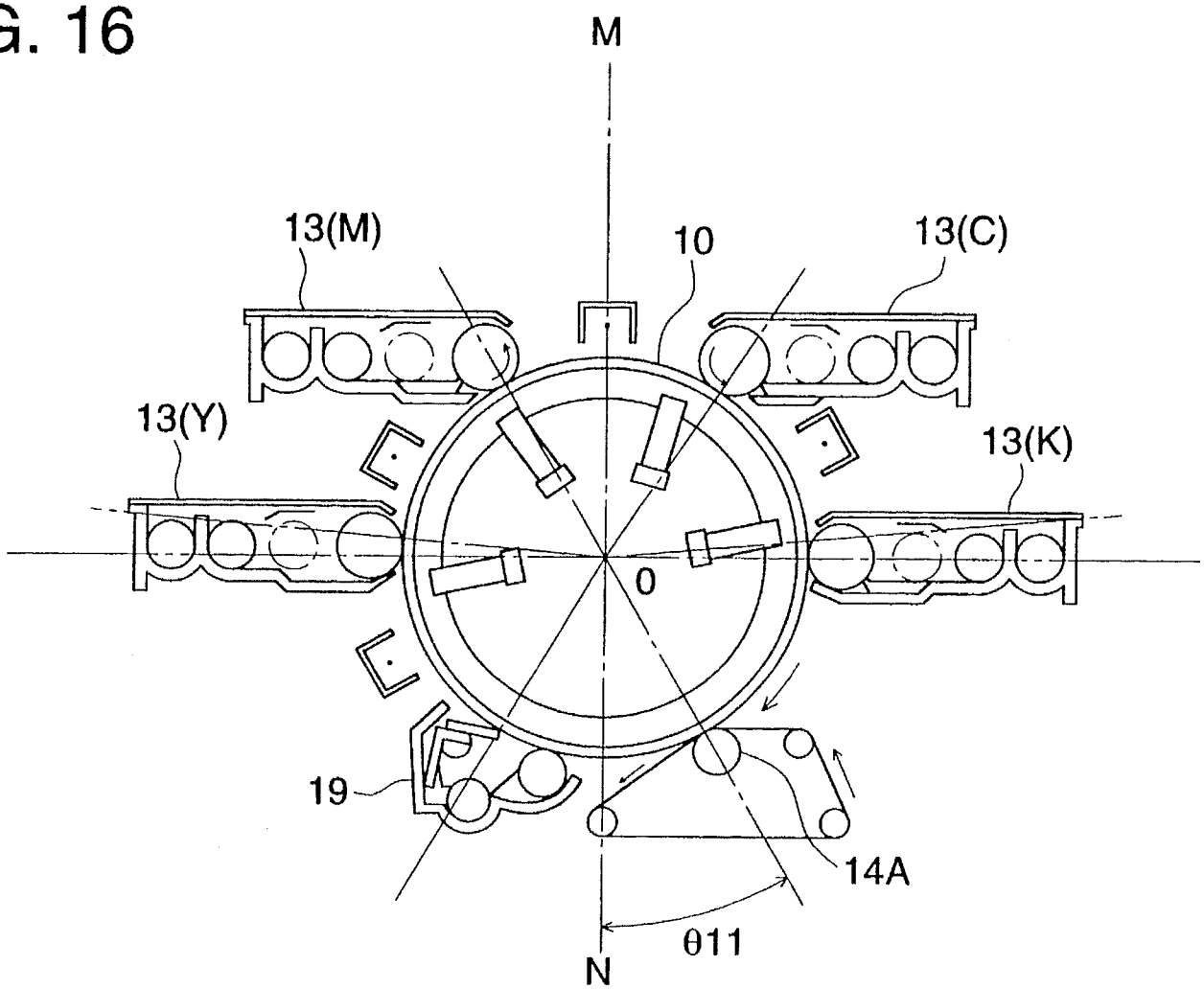
FIG. 16 is an illustration of a primary portion of the apparatus mentioned above.

Namely, in the present apparatus, it is possible to use photoreceptor drum 10 having a small diameter for the reason that exposure optics systems 12(Y, M, C and K) are housed in the photoreceptor drum, and the aforesaid developing units 13(Y, M, C and K) are arranged symmetrically on the right and left of vertical line MON passing through the center of the drum as shown in FIG. 16 so that the cartridge 30 may be well-balanced.

From the viewpoint of space distribution around the circumferential surface of the drum, therefore, the transfer roller 14A is arranged at the position that is upstream side by angle 811 from vertical line ON on the lower side of the drum in terms of the drum rotation (practically, 10°–65°). As a result, the transfer sheet is conveyed to a transfer section while being inclined by a slight inclination, and even after transferring, the transfer sheet is conveyed with that inclination.

The present apparatus, therefore, employs a means wherein sheet feeding cassette 15 is housed at the lower portion of the apparatus and the transfer sheet is bent to be a U-shaped form to be fed, without employing a means to feed the transfer sheet linearly to the transfer section. Thereby, the so-called duplex unit composed of the guide member 51 and sheet feeding path 15B can be housed in the sheet feeding path in the present apparatus.

(Example 7)

Example 7 attaining the third object of the invention will be explained as follows, referring to FIG. 15.

The aforesaid fixing unit 17 is composed of heat roller 17A that is driven at a fixed position and pressure roller 17B that is brought into pressure contact with a lower portion of the heat roller to be driven thereby.

Both ends of the pressure roller 17B are supported rotatably on one end of L-shaped crank member 52 provided with shaft 52A serving as a fulcrum for rotation of the crank member, and clockwise urging force of the crank member 52 caused by tensile force of tension spring 53 brings the pressure roller into pressure contact with the heat roller 17A.

The other end portion of the crank member 52 mentioned above is connected to solenoid 54 so that the crank member can also be rotated counterclockwise against the tensile force of the tension spring 53 by the solenoid 54 when it is turned on.

The aforesaid solenoid 54 is turned on by signals obtained when the photosensor S1 detects the trailing edge of a transfer sheet, and it rotates the crank member 52 counterclockwise, thereby it moves the pressure roller 17B downward so that pressure contact of the pressure roller with the heat roller 17A is released. As a result, the transfer sheet is fed to the image transfer section again without causing deterioration of image quality caused by repeated fixing operations. Heating of the heat roller 17A is suspended temporarily simultaneously with the releasing of pressure contact mentioned above.

The aforesaid solenoid 54 is turned off during a period from the moment when the transfer sheet has passed fixing roller section 17 to the moment to start fixing a toner image on the reverse side of the transfer sheet so that the crank member 52 is released to return the pressure roller 17B to its pressure contact state. When the length of the reversal sheet feeding path for feeding to the image transfer section the transfer sheet again after turning it upside down, namely the length of the conveyance path for the transfer sheet from the photosensor S2 to the timing roller 16 is made to be slightly longer than that of the maximum transfer sheet to be used, the signal obtained when the photosensor S2 shown in FIG. 15 detects the trailing edge of the transfer sheet can be utilized. That signal can control the direction of rotation of each of the aforesaid rollers, switching of positions for the guide member 51, pressure contact of the pressure roller 17B and reheating of the heat roller 17A. It is also possible to control the leading edge of the transfer sheet and to conduct the similar control by providing photosensor S3 before the timing roller 16 in place of the photosensor S2.

The transfer sheet having toner images transferred and fixed on its both sides in the manner mentioned above is conveyed by conveyance rollers R1, R2 and R3 onto an exit tray located at the upper portion of the apparatus through exit roller 18.

(Example 8)

Another example will be explained as follows, referring to FIG. 15 as in the previous example.

In the apparatus of the present example, the transfer sheet having toner images transferred and fixed on its both sides as explained in the aforesaid FIG. 15 is fed again to the reversal sheet feeding path to be turned upside down again, and is exited.

Namely, when the trailing edge of the transfer sheet having toner images transferred and fixed on its both sides is detected again by the photosensor S1, its second detection signal switches the heat roller 17A and the conveyance rollers R1, R2 and R3 to rotate in the reverse direction, and concurrently with this, the guide member 51 is changed to the position shown with broken lines and the pressure roller 17B is released from its pressure contact.

Accordingly, the transfer sheet is conveyed reversely into the fixing unit 17 again and is conveyed to the timing roller 16 again through the sheet feeding path 15B and the sheet feeding path 15A, being guided by the guide member 51.

When the trailing edge of the transfer sheet thus fed again to the reversal sheet feeding path is detected by the photosensor S2 again, its second detection signal switches the heat roller 17A and the conveyance rollers R1, R2 and R3 to rotate in the regular direction while keeping pressure roller 17B to be released from pressure contact, and concurrently with this, the guide member 51 is returned to the position shown with solid lines, and functions of bias impression for image forming and transfer are made to be in the suspended state, though image forming object 10 and transfer means 14A and 14C rotate.

Accordingly, the transfer sheet is turned upside down and is fed out of the fixing unit 17 with the toner image transferred first facing upward, and then is exited on the exit tray at the upper portion of the apparatus with the aforesaid toner image facing downward. As a result, the transfer sheets are stacked with their image faces which are in order in terms of page. During this period, heating for the heat roller 17A is suspended while the pressure roller 17B is released from its pressure contact.

The aforementioned non-pressure contact state of the pressure roller 17B, suspension of heating for the heat roller 17A, and suspension of functions of image forming and transfer bias impression are all canceled by the third detection signal obtained when the photosensor S1 detects the trailing edge of the transfer sheet exited.

(Example 9)

Figure 17:
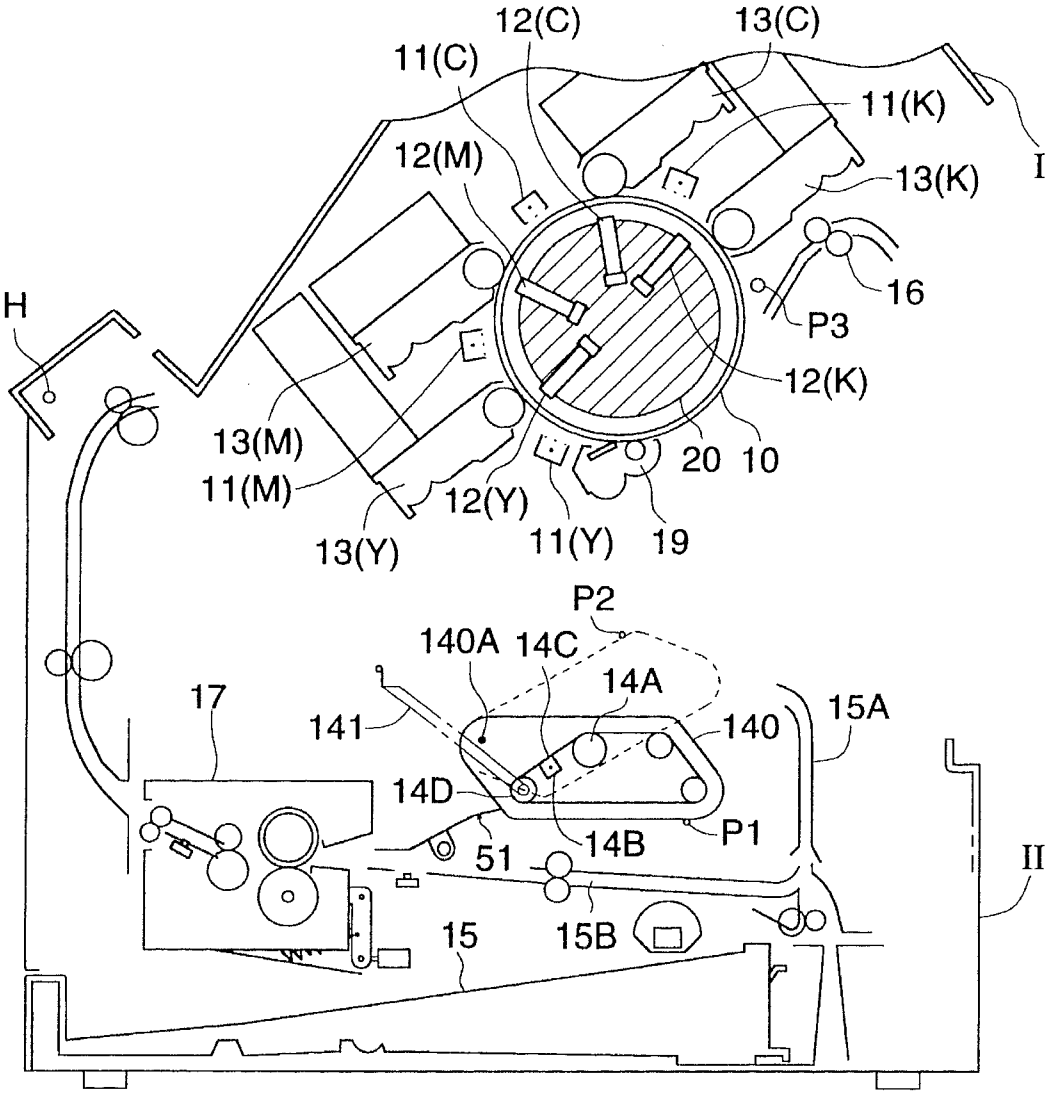
FIG. 17 is an illustration of an apparatus in accordance with the third embodiment for attaining the third object of the invention.

Still another example will be explained as follows, referring to FIG. 17.

An apparatus of the present example is divided into upper main body I and lower main body II, and when the upper main body I is rotated counterclockwise by a certain angle with hinge H as a fulcrum and held at that position, the upper face of the lower main body II is caused to be open widely.

In the upper main body I, there are housed image forming members such as photoreceptor drum 10, charging units 11(Y, M, C and K), exposure optics systems 12(Y, M, C and K), developing units 13(Y, M, C and K), and cleaning unit 19, while, in the lower main body II, there is housed a duplex unit composed of the transfer roller 14A mentioned above, fixing unit 17, sheet feeding cassette 15, sheet feeding paths 15A and 15B mentioned above and guide member 51.

On the other hand, the above-mentioned transfer roller 14A, neutralizing unit 14B and transfer belt 14C all constituting the duplex unit are supported between a pair of unified side plates 140 and are urged clockwise around a fulcrum of shaft 140A by the tensile force of tension spring 141 provided with tension between an extended shaft of rotary roller 14D and the apparatus main body, and they are arranged to be at the transfer position when an edge of the side plate 140 comes into contact with stopper pin P1.

After the upper main body I is opened upward, the side plates 140 mentioned above rotate counterclockwise around a fulcrum of the aforesaid shaft 140A until the side plate comes into contact with stopper pin P2 so that the inside of the duplex unit is caused to be open. At that position of the side plates, the tensile force of the tension spring 141 urges the side plates 140 counterclockwise, and thereby the open state of the duplex unit can be locked, namely, it is kept.

Therefore, the maintenance such as jam clearance and others can be carried out easily and efficiently.

When the upper main body I is closed, the side plates 140 are rotated clockwise being pressed by pressure pin P3 provided on the upper main body I, and when the side plates have covered a prescribed angle of rotation, they are urged clockwise by the tensile force of the tension spring 141 and are returned to the transfer position when the stopper pin P1 comes into contact therewith.

(Example 10)

Figure 18:
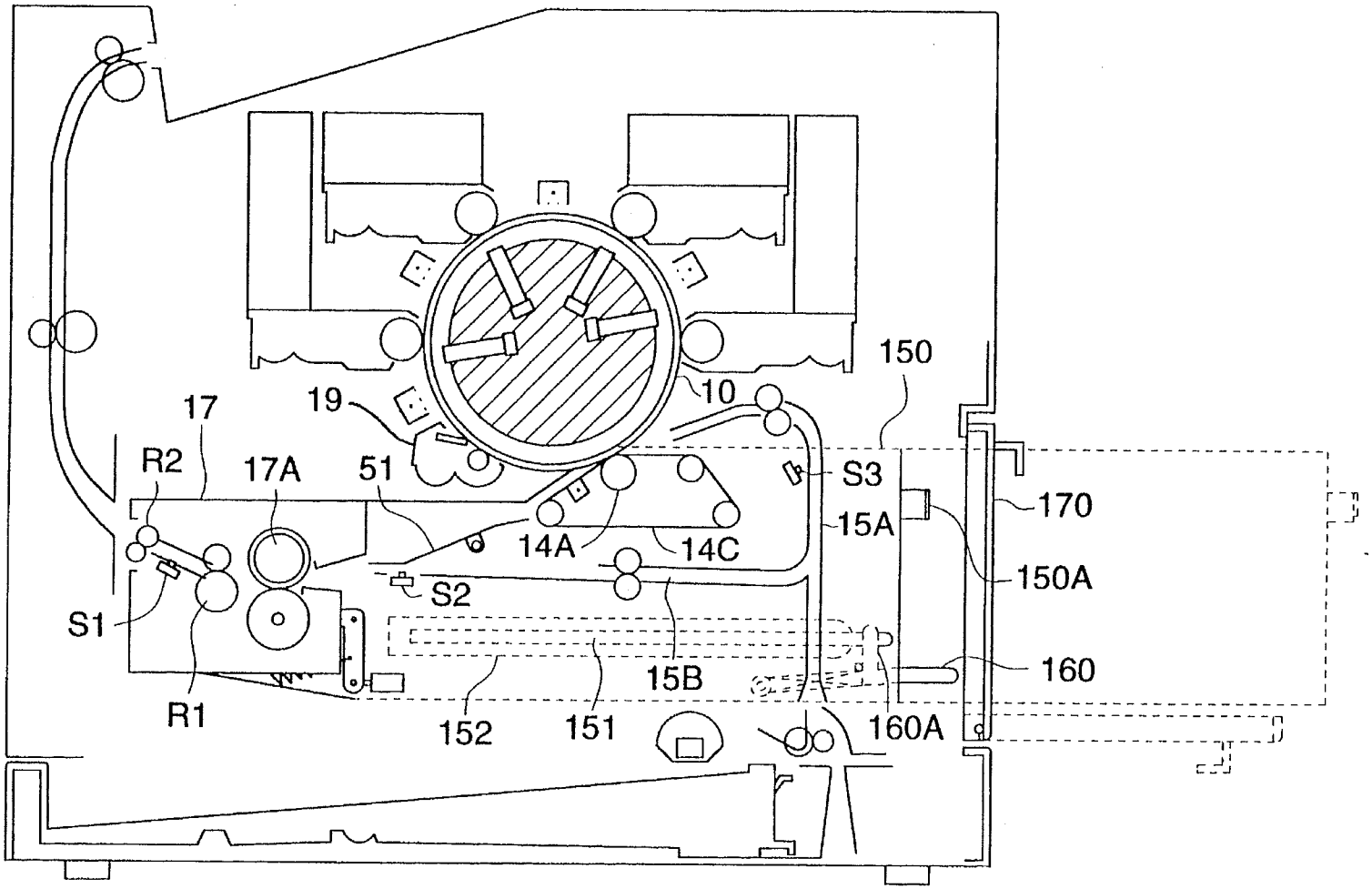
FIG. 18 is an illustration of an apparatus in accordance with the fourth embodiment for attaining the third object of the invention.

Another example will be explained as follows, referring to FIG. 18.

In an apparatus of the present example, the above-mentioned transfer roller 14A, sheet feeding paths 15A and 15B, guide member 51 and fixing unit 17 are incorporated solidly in carriage 150 as a duplex unit so that they can be mounted inside the apparatus or dismounted therefrom simultaneously.

The aforesaid carriage 150 is inserted horizontally with its rail members 151 provided on both sides of the carriage being guided by guide members 152 provided on both internal sides of the apparatus main body, and is mounted at a prescribed setting position with a notch on the rail member 151 engaged with hook 160A on lock lever 160 provided on the apparatus main body.

When the carriage 150 is at its position for mounting, power for the transfer roller 14A and fixing unit 17 or transmission system for electric power and the control circuit of sequence are connected, and image transfer and image fixing are conducted.

Since the transfer roller 14A is pressed through transfer belt 14C, it is preferable that the transfer roller retreats from an image forming object in the case of dismounting.

The aforesaid carriage 150 can be drawn out of the apparatus by pulling it out by handle 150A while depressing the lock lever 160 when the side cover 170 that forms an enclosure of the apparatus is opened.

Therefore, the maintenance such as jam clearance and others can be carried out easily and efficiently.

When the carriage 150 is drawn out, the aforesaid power, electric power and control circuit are automatically disconnected, and they are connected automatically when the carriage is mounted again.

(Example 11)

Another example will be explained as follows, referring to FIG. 19.

The transfer belt 14C is stretched around transfer roller 14A, rotating rollers 14D, 14E and 14F and is driven by the rotating roller 14D while keeping a predetermined tension given by the rotating roller 14F that is urged outward.

At the downstream side from the neutralizing unit 14B in terms of belt movement direction, there are provided a pair of roller members 180 almost vertically, and the transfer belt 14C touches internally the upper one of the roller members 180 and touches the lower one thereof externally so that the transfer belt is moved while forming an S-shaped curve.

As a result, with regard to the transfer belt 14C located between the transfer roller 14A and the rotating roller 14C, an inclination angle thereof at the upstream side of the roller members 180 can be different from that at the downstream side, and it is possible to make the transfer belt 14C at the downstream side to be the conveyance face that is almost horizontal as shown in the figure.

Figure 19:
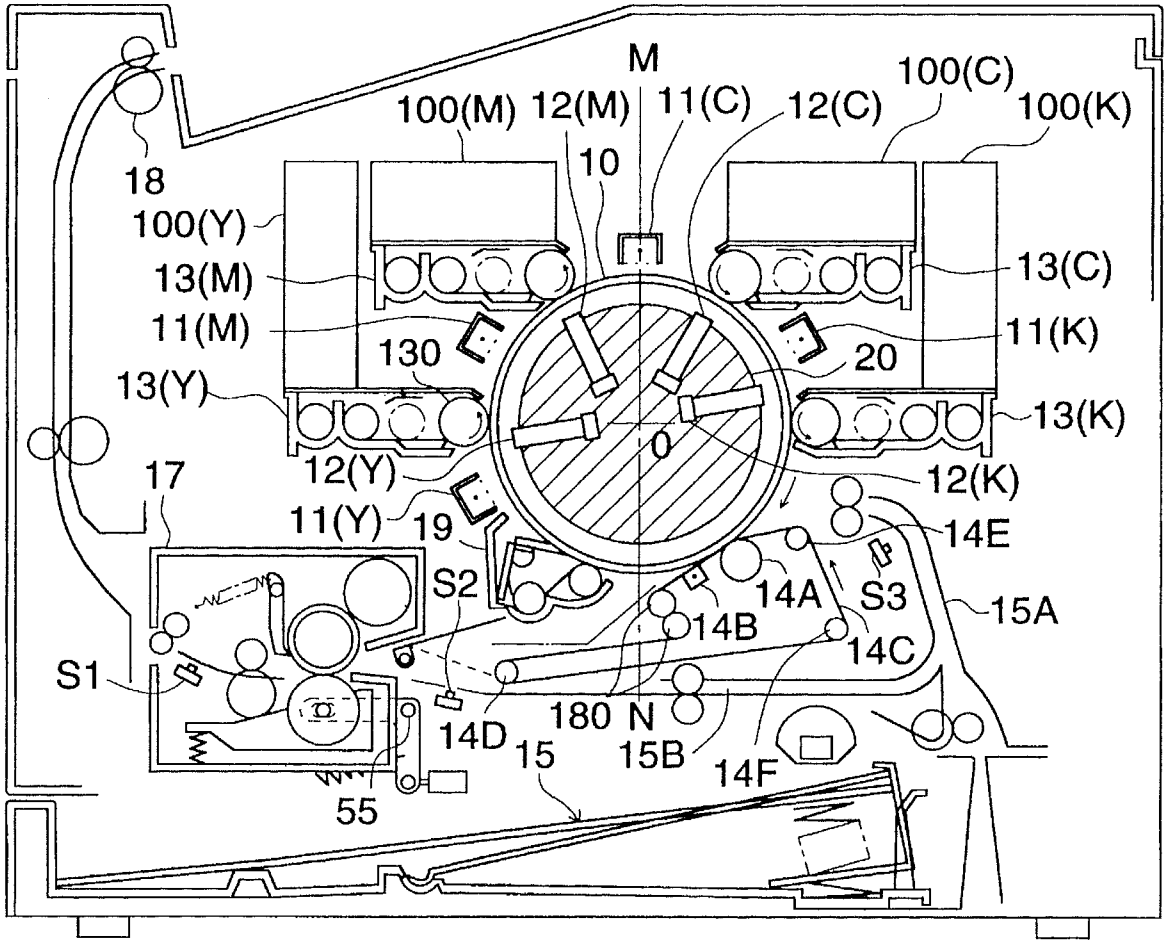
FIG. 19 is an illustration of an apparatus in accordance with the fifth embodiment for attaining the third object of the invention.

Accordingly, the transfer sheet on which a toner image has been transferred at an image transfer section is conveyed while being inclined right after transferring as shown in FIG. 19, but it is conveyed almost horizontally after passing the roller members 180. Therefore, the position of the fixing unit 17 does not need to be lowered in particular, and the height of the apparatus does not need to be increased accordingly.

When the transfer sheet is turned upside down and is fed to the image transfer section again, the position needs to be switched by guide member 55 provided at the position prior to the fixing unit.

The present invention is especially effective when the transfer roller 14A is provided at the position which is extremely upstream in terms of rotation from the vertical line O-N at the lower portion of the drum.

In the present invention, there is offered a duplex unit wherein the constitution of a sheet feeding path for a transfer sheet is simple and can be made to be a unit, and thereby an extremely useful duplex color image forming apparatus which is low in height, compact in size, and makes its maintenance such as jam clearing to be conducted efficiently.

What is claimed is:

1. A color image forming apparatus comprising:

(a) an image forming body having a first surface and a second surface provided on a rear side of said first surface;

(b) a plurality of chargers each for charging said first surface of said image forming body;

(c) a plurality of image exposure means each for image-wise exposing said image forming body from said second surface to thereby form an electrostatic latent image on said first surface;

(d) a plurality of developing means for developing each of the latent images formed on said first surface so that a plurality of different colored toner images are registered on said first surface, said plurality of developing means having a first, a second, a third and a fourth developing units in order along an outer circumference of said first surface of said image forming body, each of said first, second, third and fourth developing units having a developing sleeve for carrying each different colored developer thereon, wherein two each of said plurality of developing means are located on both sides with respect to a vertical line which passes through a center of said image forming body, and wherein said first, second, third and fourth developing units are located so that the following conditions are satisfied:

θ1 and θ4 are from 0° to 20°,

θ2 and θ3 are from 45° to 75°, where θ1 represents an angle between a horizontal line which passes the center of said image forming body and a line connecting the center of said image forming body with a center of said developing sleeve of said first developing unit; θ2 represents an angle between the horizontal line and a line connecting the center of said image forming body with a center of said developing sleeve of said second developing unit; θ3 represents an angle between the horizontal line and a line connecting the center of said image forming body with a center of said developing sleeve of said third developing unit; and θ4 represents an angle between the horizontal line and a line connecting the center of said image forming body with a center of said developing sleeve of said fourth developing unit;

(e) a transferring means for transferring said plurality of toner images registered on said first surface of said image forming body onto a recording media at one time; and (f) a cleaning means for cleaning a residual toner on said first surface of said image forming body.

2. The color image forming apparatus of claim 1, wherein said transferring means having a transferring position closest to said image forming body is located opposite to said second and third developing units with respect to the horizontal line, and the following condition is satisfied:

θ5 is from 5° to 40°, where θ5 represents an angle between the vertical line and a line connecting the center of said image forming body with the transferring position of said transferring means.

3. The color image forming apparatus of claim 1, wherein said cleaning means is located opposite to said second and third developing units with respect to the horizontal line, and the following condition is satisfied:

θ6 is from 10° to 50°, where θ6 represents an angle between the vertical line and a line connecting the center of said image forming body with a position where said cleaning means is in contact with said image forming body.

4. The color image forming apparatus of claim 1, wherein said transferring means and said cleaning means are located opposite to said second and third developing units with respect to the horizontal line, and are located opposite to each other with respect to the vertical line, and the following conditions are satisfied:

θ5 is from 5° to 40° and

θ6 is from 10° to 50°, where θ5 represents an angle between the vertical line and a line connecting the center of said image forming body with a transferring position disposed closest to said image forming body, and θ6 represents an angle between the vertical line and a line connecting the center of said image forming body with a position where said cleaning means is in contact with said image forming body.

5. The color image forming apparatus of claim 4, wherein said second and third developing units are located below the horizontal line.

6. The color image forming apparatus of claim 4, wherein said second and third developing units are located above the horizontal line.

7. The color image forming apparatus of claim 6 further comprising:

a first conveyor for conveying a recording media onto the transferring position of said transferring means;

a fixer for fixing a toner image on said recording media; and a second conveyor for conveying the recording media having an image on one side thereof which has been fixed, onto said transferring position in a second time, wherein said second conveyor is disposed below said transferring means.

8. The color image forming apparatus of claim 7, wherein said fixer comprises means for applying a pressure onto the recording media and for releasing the pressure from said recording media, and wherein said recording media having the image on said one side which has been fixed is conveyed in the same direction as a conveying direction of said second conveyor while keeping the pressure to said recording media released.

9. The color image forming apparatus of claim 1, wherein said first, second, third and fourth developing units have a first, second, third and fourth toner hoppers each for storing a different colored toner on top of said respective developing units.

10. The color image forming apparatus of claim 9, wherein a toner replenishment operation to each of said first, second, third and fourth toner hoppers is conducted from a top of a main body of said color image forming apparatus.

11. The color image forming apparatus of claim 9, wherein respective said first, second, third and fourth toner hoppers corresponding to respective said first, second, third and fourth developing units are integrally formed in a unit respectively, and detachably attachable to a main body of said color image forming apparatus respectively.

12. The color image forming apparatus of claim 9, wherein respective said first, second, third and fourth toner hoppers are detachably attachable to said first, second, third and fourth developing units respectively.

* * * * *